US008310421B2

(12) United States Patent
Todorovich

(10) Patent No.: US 8,310,421 B2
(45) Date of Patent: Nov. 13, 2012

(54) DISPLAY DRIVE SWITCH CONFIGURATION

(75) Inventor: Mark M. Todorovich, San Diego, CA (US)

(73) Assignee: Qualcomm Mems Technologies, Inc., San Diego, CA (US)

( * ) Notice: Subject to any disclaimer, the term of this patent is extended or adjusted under 35 U.S.C. 154(b) by 360 days.

(21) Appl. No.: 12/683,333

(22) Filed: Jan. 6, 2010

(65) Prior Publication Data

US 2011/0164014 A1 Jul. 7, 2011

(51) Int. Cl.
*G09G 3/34* (2006.01)

(52) U.S. Cl. ..... 345/85; 345/210

(58) Field of Classification Search ..... 345/208–211, 345/85, 95, 108
See application file for complete search history.

(56) References Cited

U.S. PATENT DOCUMENTS

| | | | | |
|---|---|---|---|---|
| 4,954,789 | A | 9/1990 | Sampsell | |
| 5,784,189 | A | 7/1998 | Bozler et al. | |
| 6,040,937 | A | 3/2000 | Miles | |
| 6,504,523 | B1 * | 1/2003 | Sugawara et al. | 345/98 |
| 6,574,033 | B1 | 6/2003 | Chui et al. | |
| 6,674,562 | B1 | 1/2004 | Miles et al. | |
| 7,042,643 | B2 | 5/2006 | Miles | |
| 7,123,216 | B1 | 10/2006 | Miles | |
| 7,289,259 | B2 | 10/2007 | Chui et al. | |
| 7,327,510 | B2 | 2/2008 | Cummings et al. | |
| 7,446,927 | B2 | 11/2008 | Chui | |
| 7,560,299 | B2 | 7/2009 | Cummings | |
| 7,889,163 | B2 | 2/2011 | Chui et al. | |
| 7,990,604 | B2 | 8/2011 | Lee et al. | |
| 2002/0000964 | A1 * | 1/2002 | Sumiya | 345/87 |
| 2002/0054005 | A1 | 5/2002 | Edwards et al. | |
| 2004/0115864 | A1 | 6/2004 | Sakurai et al. | |
| 2005/0067681 | A1 | 3/2005 | De Villeneuve et al. | |
| 2006/0256065 | A1 * | 11/2006 | Jung | 345/100 |
| 2006/0290637 | A1 * | 12/2006 | Kang et al. | 345/98 |
| 2007/0057628 | A1 * | 3/2007 | Kim | 313/504 |
| 2007/0086078 | A1 | 4/2007 | Hagood et al. | |
| 2007/0195031 | A1 * | 8/2007 | Miller et al. | 345/87 |
| 2009/0115701 | A1 | 5/2009 | Kim et al. | |
| 2009/0135464 | A1 | 5/2009 | Sampsell et al. | |
| 2010/0245313 | A1 | 9/2010 | Lewis et al. | |

FOREIGN PATENT DOCUMENTS

| | | |
|---|---|---|
| EP | 1 801 774 | 6/2007 |
| EP | 1 818 897 | 8/2007 |

OTHER PUBLICATIONS

Qualcomm, May 2008, Interferometric Modulator (IMOD) Technology Overview (White Paper), 16 pp.
Invitation to Pay Additional Fees dated Apr. 14, 2011 in PCT/US11/020056.
ISR and WO dated Jul. 11, 2011 in PCT/US11/020056.

* cited by examiner

*Primary Examiner* — Chanh Nguyen
*Assistant Examiner* — Allison Walthall
(74) *Attorney, Agent, or Firm* — Knobbe Martens Olson & Bear, LLP

(57) ABSTRACT

An apparatus and method for driving a display a display. Two switches for each common line are used to couple the common line to a respective first and second hold voltage supply lines. A third switch for each common line is used to couple the common line to a drive line. A waveform generator is used to generate the driving waveform on the drive line.

25 Claims, 17 Drawing Sheets

Common Voltages

| Segment Voltages | $VC_{ADD_H}$ | $VC_{HOLD_H}$ | $VC_{REL}$ | $VC_{HOLD_L}$ | $VC_{ADD_L}$ |
|---|---|---|---|---|---|
| $VS_H$ | Stable | Stable | Relax | Stable | Actuate |
| $VS_L$ | Actuate | Stable | Relax | Stable | Stable |

DISPLAY DRIVE SWITCH CONFIGURATION

BACKGROUND

1. Field of the Invention

The present invention relates to switch configuration to reduce the amount of circuitry used to drive an interferometric modulator display.

2. Description of Related Technology

Electromechanical systems (EMS) include mechanical elements, actuators, and electronics. Mechanical elements may be created using deposition, etching, and or other machining processes that etch away parts of substrates and/or deposited material layers or that add layers to form electrical and electromechanical devices. One type of EMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Preferred Embodiments" one will understand how the features of this invention provide advantages over other display devices.

One aspect of the invention includes an apparatus for driving a display. The apparatus includes a first voltage supply line configured to supply a first voltage, a second voltage supply line configured to supply a second voltage, one or more drive lines configured to supply a driving voltage waveform, a waveform generator configured to generate the driving voltage waveform on the one or more drive lines, a first switch configured to selectively couple a first one of a plurality of rows or columns to the first voltage supply line, a second switch configured to selectively couple the first one of the rows or columns to the second voltage supply line, and a third switch configured to selectively couple the first one of the rows or columns to a first drive line of the one or more drive lines.

Another aspect of the invention includes a method of displaying information a display. The method comprises activating a first switch to couple a first one of a plurality of rows or columns to a first voltage supply line configured to supply a first voltage, deactivating the first switch to uncouple the first one of the rows or columns from the first voltage supply line, generating a driving voltage waveform on a first drive line, activating a second switch to couple the first one of the rows or columns to the first drive line, deactivating the second switch to uncouple the first one of the rows or columns from the first drive line, and activating a third switch to couple the first one of the rows or columns to a second voltage supply line configured to supply a second voltage.

Another aspect of the invention includes an apparatus for driving a display. The apparatus comprised means for supplying a first voltage, means for supplying a second voltage, one or more means for supplying a driving voltage waveform, means for generating the driving voltage waveform on the one or more means for supplying the driving voltage waveform, means for selectively coupling a first one of a plurality of rows or columns to the means for supplying the first voltage, means for selectively coupling the first one of the rows or columns to the means for supplying the second voltage, and means for selectively coupling the first one of the rows or columns to a first means of the one or more means for supplying a driving voltage waveform.

Another aspect of the invention includes a computer-readable medium having stored thereon, instructions that, if executed by a computing device, cause the computing device to perform a method of displaying information on a display. The method comprises activating a first switch to couple a first one of a plurality of rows or columns to a first voltage supply line configured to supply a first voltage, deactivating the first switch to uncouple the first one of the rows or columns from the first voltage supply line, generating a driving voltage waveform on a first drive line, activating a second switch to couple the first one of the rows or columns to the first drive line, deactivating the second switch to uncouple the first one of the rows or columns from the first drive line, and activating a third switch to couple the first one of the rows or columns to a second voltage supply line configured to supply a second voltage.

DETAILED DESCRIPTION

The following detailed description is directed to certain specific embodiments. However, the teachings herein can be applied in a multitude of different ways. In this description, reference is made to the drawings wherein like parts are designated with like numerals throughout. The embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). EMS devices of similar structure to those described herein can also be used in non-display applications such as in electronic switching devices.

Conventional approaches to generating driving waveforms on common lines of a display have included providing switches for coupling each potentially needed voltage level to each common line. This approach involves a significant amount of circuitry given the number of potential voltage lines and the number of common lines. Methods and devices are described herein to reduce the amount of circuitry used per common line to generate driving waveforms. In one embodiment, each common line is provided three switches. Two of the switches couple the common line to respective hold voltages. The third switch couples the common line to a variable voltage drive line that selectively provides the remaining voltage levels used in the driving wave form. A wave form generator is used to selectively control the voltage on the drive line. In this manner the number of switches per line may be reduced.

Figure 1:
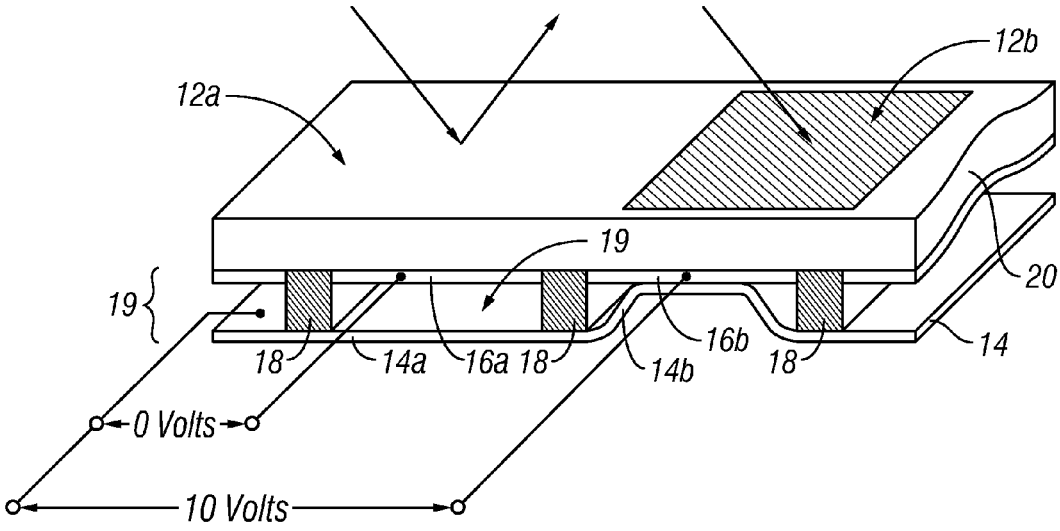
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric EMS display element is illustrated in FIG. 1. In these devices, the pixels are in either a bright or dark state. In the bright ("relaxed" or "open") state, the display element reflects a large portion of incident visible light to a user. When in the dark ("actuated" or "closed") state, the display element reflects little incident visible light to the user. Depending on the embodiment, the light reflectance properties of the "on" and "off" states may be reversed. EMS pixels can be configured to reflect predominantly at selected colors, allowing for a color display in addition to black and white.

FIG. 1 is an isometric view depicting two adjacent pixels in a series of pixels of a visual display, wherein each pixel comprises a EMS interferometric modulator. In some embodiments, an interferometric modulator display comprises a row/column array of these interferometric modulators. Each interferometric modulator includes a pair of reflective layers positioned at a variable and controllable distance from each other to form a resonant optical gap with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. The partially reflective layer can be formed of one or more layers of materials, and each of the layers can be formed of a single material or a combination of materials.

In some embodiments, the layers of the optical stack 16 are patterned into parallel strips, and may form column electrodes in a display device as described further below. The movable reflective layers 14*a*, 14*b* may be formed as a series of parallel strips of a deposited metal layer or layers (orthogonal to the column electrodes of 16*a*, 16*b*) to form rows deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form row electrodes in a display device. Note that FIG. 1 may not be to scale. In some embodiments, the spacing between posts 18 may be on the order of 10-100 um, while the gap 19 may be on the order of <1000 Angstroms.

With no applied voltage, the gap 19 remains between the movable reflective layer 14*a* and optical stack 16*a*, with the movable reflective layer 14*a* in a mechanically relaxed state, as illustrated by the pixel 12*a* in FIG. 1. However, when a potential (voltage) difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by actuated pixel 12*b* on the right in FIG. 1. The behavior is the same regardless of the polarity of the applied potential difference.

FIGS. 2 through 5 illustrate one exemplary process and system for using an array of interferometric modulators in a display application.

Figure 2:
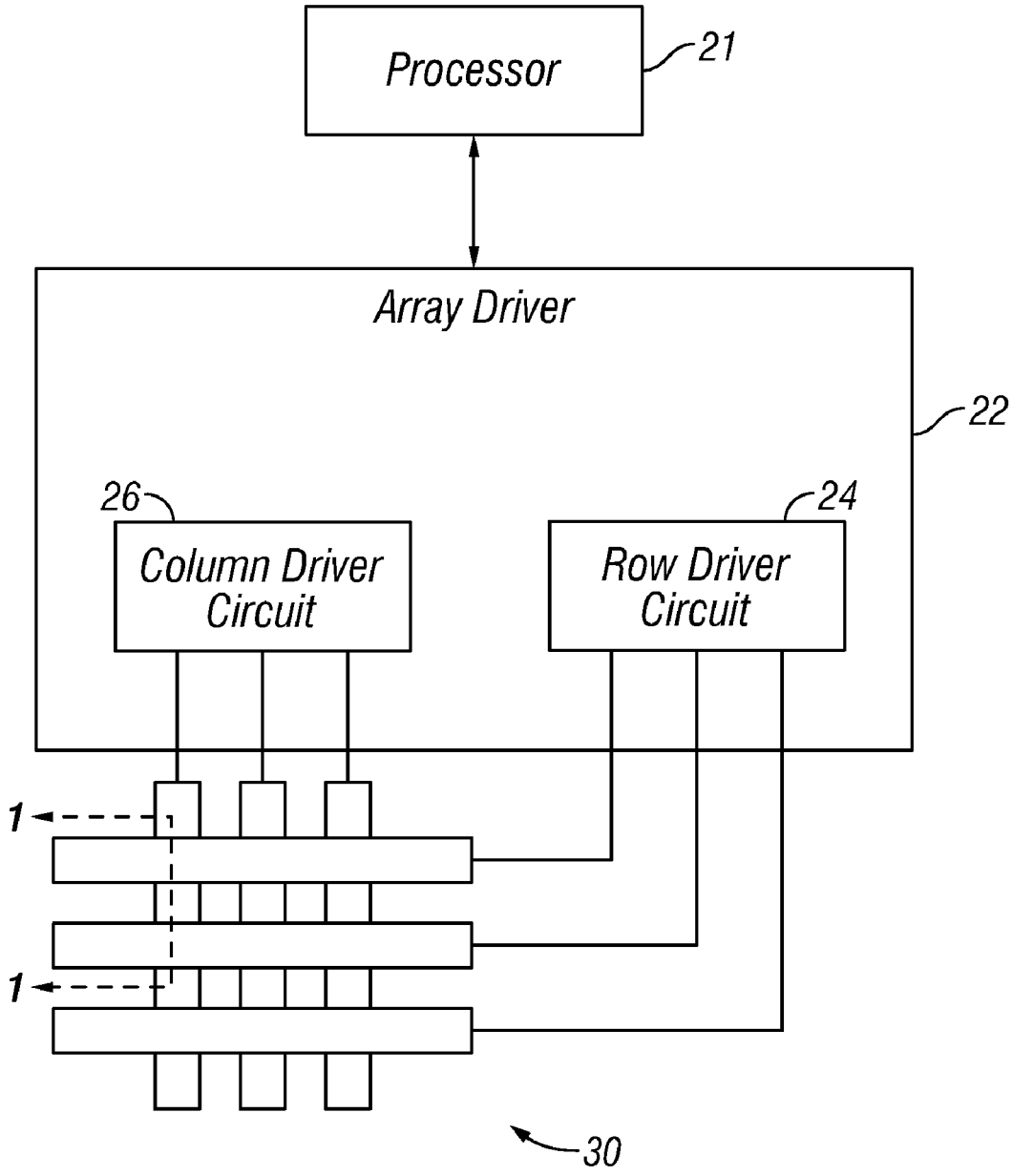
FIG. 2 is a system block diagram illustrating one embodiment of an electronic device incorporating a 3×3 interferometric modulator display.

FIG. 2 is a system block diagram illustrating one embodiment of an electronic device that may incorporate interferometric modulators. The electronic device includes a processor 21 which may be any general purpose single- or multi-chip microprocessor such as an ARM®, Pentium®, 8051, MIPS®, Power PC®, or ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. Note that although FIG. 2 illustrates a 3×3 array of interferometric modulators for the sake of clarity, the display array 30 may contain a very large number of interferometric modulators, and may have a different number of interferometric modulators in rows than in columns (e.g., 300 pixels per row by 190 pixels per column).

Figures 3, 4:
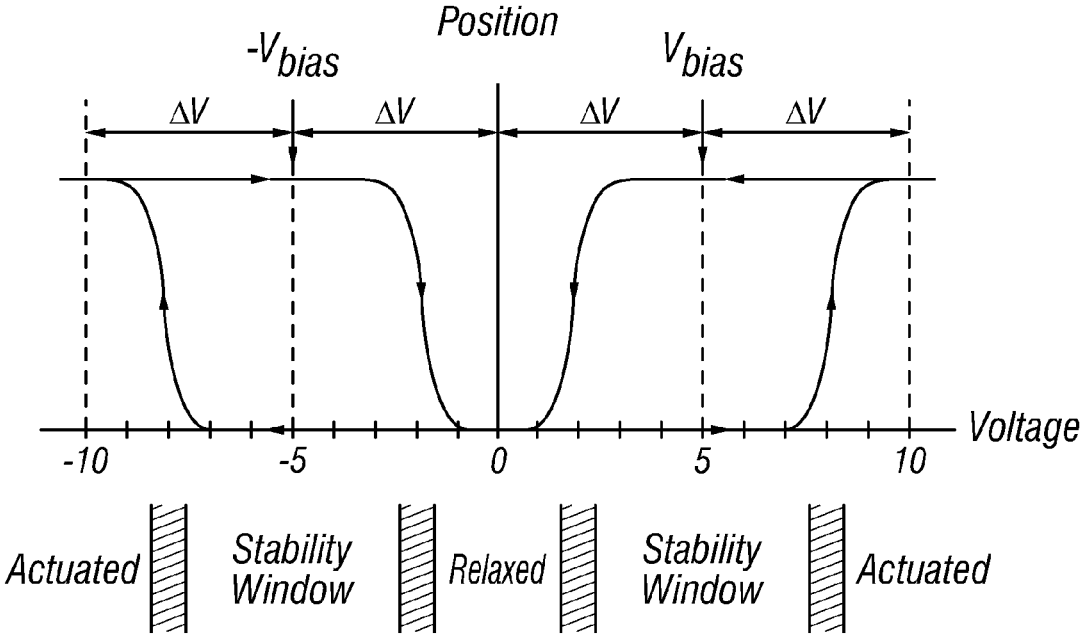
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIG. 3 is a diagram of movable mirror position versus applied voltage for one exemplary embodiment of an interferometric modulator of FIG. 1. For EMS interferometric modulators, the row/column actuation protocol may take advantage of a hysteresis property of these devices as illustrated in FIG. 3. An interferometric modulator may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state or bias voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

As described further below, in typical applications, a frame of an image may be created by sending a set of data signals (each having a certain voltage level) across the set of column electrodes in accordance with the desired set of actuated pixels in the first row. A row pulse is then applied to a first row electrode, actuating the pixels corresponding to the set of data signals. The set of data signals is then changed to correspond to the desired set of actuated pixels in a second row. A pulse is then applied to the second row electrode, actuating the appropriate pixels in the second row in accordance with the data signals. The first row of pixels are unaffected by the second row pulse, and remain in the state they were set to during the first row pulse. This may be repeated for the entire series of rows in a sequential fashion to produce the frame. Generally, the frames are refreshed and/or updated with new image data by continually repeating this process at some desired number of frames per second. A wide variety of protocols for driving row and column electrodes of pixel arrays to produce image frames may be used.

Figure 5A:
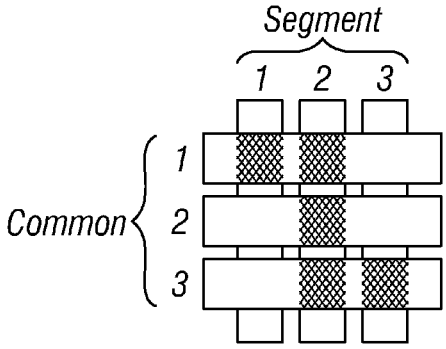
FIGS. 5A and 5B illustrate one exemplary timing diagram for row and column signals that may be used to write a frame of display data to the 3×3 interferometric modulator display of FIG. 2.

FIGS. 4 and 5 illustrate one possible actuation protocol for driving an array of electromechanical devices such as an array of interferometric modulators. FIG. 4 illustrates a possible set of column and row voltage levels that may be used for modulators exhibiting the hysteresis properties illustrated in FIG. 3. In the embodiment of FIG. 4 (also see FIG. 5A), as many as five or more possible voltages may be applied along a common line (which may be either a row or column line, in various embodiments) in order to address specific common lines, and at least two possible voltages may be applied along segment lines to write data to the common line(s) currently being addressed.

When a release voltage $VC_{REL}$ is applied along a common line, all interferometric modulator elements along the common line will be placed in a relaxed state, alternatively referred to as a released or unactuated state, regardless of the voltage applied along the segment lines. The release voltage $VC_{REL}$ and the high and low segment voltages $VS_H$ and $VS_L$ are selected accordingly. In particular, when the release voltage $VC_{REL}$ is applied along a common line, the potential voltage across the modulator (alternatively referred to as a pixel voltage) is within the relaxation window (see FIG. 3, also referred to as a release window) both when the high segment voltage $VS_H$ and the low segment voltage $VS_L$ are applied along the corresponding segment line. The difference between the high and low segment voltage, also referred to as the segment voltage swing, is less than the width of the relaxation window.

When a hold voltage is applied on a common line, such as a high hold voltage $VC_{HOLD_H}$ or a low hold voltage $VC_{HOLD_L}$, the state of the interferometric modulator will remain constant. $VC_{HOLD_H}$ and $VC_{HOLD_L}$ may also be referred to as a positive and negative hold voltage respectively. A relaxed modulator will remain in a relaxed position, and an actuated modulator will remain in an actuated position. The hold voltages are selected such that the pixel voltage will remain within a stability window of the interferometric modulator both when the high segment voltage $VS_H$ and the low segment voltage $VS_L$ are applied along the corresponding segment line. The segment voltage swing is thus less than the width of either the positive or the negative stability window.

When an addressing voltage is applied on a common line, such as high addressing voltage $VC_{ADD_H}$ or low addressing voltage $VC_{ADD_L}$, data can be selectively written to the modulators along that line by application of segment voltages along the respective segment lines. $VC_{ADD_H}$ and $VC_{ADD_L}$, may also be referred to as positive and negative address voltages respectively. The addressing voltages are selected such that when an addressing voltage is applied along a common line, the pixel voltage will be within a stability window when one of the segment voltages is applied along the segment line, but beyond the stability window when the other is applied, causing actuation of the pixel. The particular segment voltage which causes actuation will vary depending upon which addressing voltage is used. When the high addressing voltage $VC_{ADD_H}$ is applied along the common line, application of the high segment voltage $VS_H$ will cause a modulator to remain in its current position, while application of the low segment voltage $VS_L$ causes actuation of the modulator. The effect of the segment voltages will be the opposite when a low addressing voltage $VC_{ADD_L}$ is applied, with high segment voltage $VS_H$ causing actuation of the modulator, and low segment voltage $VS_L$ having no effect on the state of the modulator.

In certain embodiments, only a high or a low hold voltage and address voltage may be used. Using both positive and negative hold and address voltages, however, allows the polarity of write procedures to be alternated, inhibiting charge accumulation which could occur after write operations of only a single polarity.

Figure 5B:
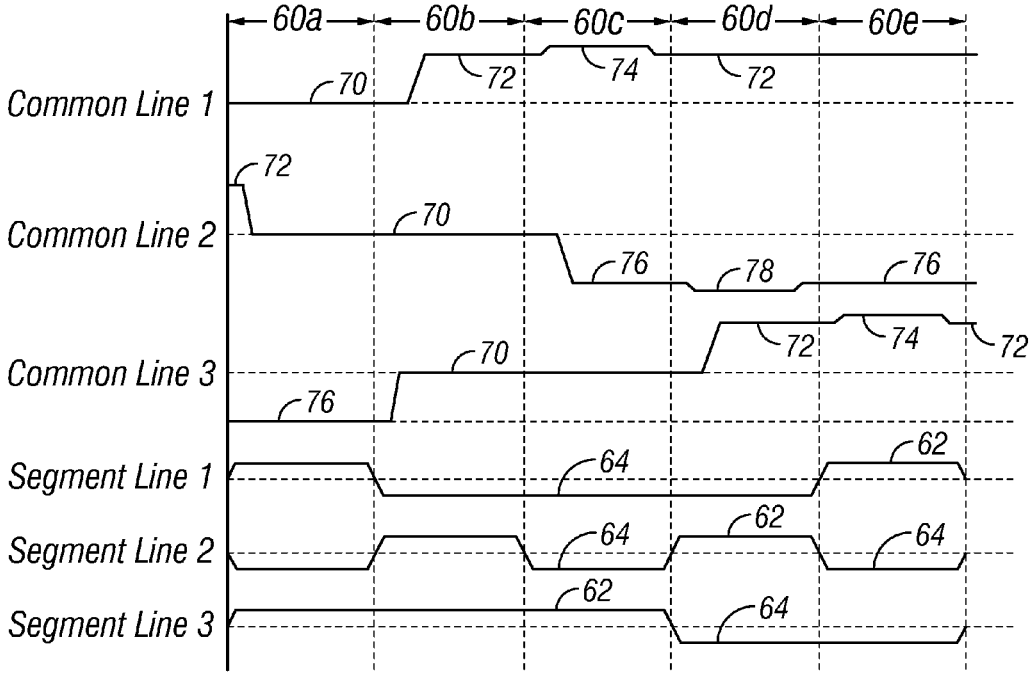

FIG. 5B is a timing diagram showing a series of common and segment voltage signals applied to the 3×3 array of FIG. 2 which will result in the display arrangement illustrated in FIG. 5A, where actuated modulators are non-reflective and illustrated as dark. Prior to writing the frame illustrated in FIG. 5A; the pixels can be in any state, but the write procedure illustrated in the timing diagram of FIG. 5B releases each modulator in a given common line prior to addressing the common line.

During the first line time 60*a*, none of common lines 1, 2, or 3 are being addressed. A release voltage 70 is applied on common line 1. The voltage applied on common line 2 begins at a high hold voltage 72 and moves to a release voltage 70. A low hold voltage 76 is applied along common line 3. Thus, the modulators (1,1), (1,2), and (1,3) along common line 1 remain in a relaxed state for the duration of the first line time 60*a*, the modulators (2,1), (2,2), and (2,3) along common line 2 will move to a relaxed state, and the modulators (3,1), (3,2), and (3,3) along common line 3 will remain in their previous state. The segment voltages applied along segment lines 1, 2, and 3 will have no effect on the state of the interferometric modulators, as none of common lines 1, 2, or 3 are being addressed during line time 60*a*.

During the second line time 60*b*, the voltage on common line 1 moves to a high hold voltage 72, and all modulators along common line 1 remain in a relaxed state regardless of the segment voltage applied. The modulators along common line 2 remain in a relaxed state, and the modulators (3,1), (3,2), and (3,3) along common line 3 will relax when the voltage along common line 3 moves to a release voltage 70.

During the third line time 60*c*, common line 1 is addressed by applying a high address voltage 74 on common line 1. Because a low segment voltage 64 is applied along segment lines 1 and 2 during the application of this address voltage, the pixel voltage across modulators (1,1) and (1,2) is greater than the positive stability window of the modulators, and modulators (1,1) and (1,2) are actuated. Because a high segment voltage 62 is applied along segment line 3, the pixel voltage across modulator (1,3) is less than that of modulators (1,1) and (1,2), and is within the positive stability window of the modulator. Modulator (1,3) thus remains relaxed. Also during line time 60*c*, the voltage along common line 2 decreases to a low hold voltage 76, and the voltage along common line 3 remains at a release voltage, leaving the modulators along common lines 2 and 3 in a relaxed position.

During the fourth line time 60*d*, the voltage on common line 1 is at a high hold voltage 72, leaving the modulators along common line 1 in their respective addressed states. Common line 2 is now addressed by decreasing the voltage on common line 2 to a low address voltage 78. Because a high segment voltage 62 is applied along segment line 2, the pixel voltage across modulator (2,2) is below the negative stability window of the modulator, causing the modulator (2,2) to actuate. Because a low segment voltage 64 is applied along segment lines 1 and 3, the modulators (2,1) and (2,3) remain in a relaxed position. The voltage on common line 3 increases to a high hold voltage 72, leaving the modulators along common line 3 in a relaxed state.

Finally, during the fifth line time 60*e*, the voltage on common line 1 remains at high hold voltage 72, and the voltage on common line 2 remains at a low hold voltage, leaving the modulators along common lines 1 and 2 in their respective addressed states. The voltage on common line 3 increases to a high address voltage to address the modulators along common line 3. As a low segment voltage 64 is applied on segment lines 2 and 3, the modulators (3,2) and (3,3) actuate, while the high segment voltage 62 applied along segment line 1 causes modulator (3,1) to remain in a relaxed position. Thus, at the end of the fifth hold time 60*e*, the 3×3 pixel array is in the state shown in FIG. 5A, and will remain in that state as long as the hold voltages are applied along the common lines, regardless of variations in the segment voltage which may occur when modulators along other common lines (not shown) are being addressed.

In the timing diagram of FIG. 5B, it can be seen that a given write procedure includes the use of either high hold and address voltages, or low hold and address voltages. Once a high or low hold voltage is applied, the pixel voltage remains within or beyond a given stability window, and does not pass through the relaxation window until a release voltage is applied. Furthermore, as each modulator is released as part of the write procedure prior to addressing the modulator, the actuation time of a modulator, rather than the release time, determines the necessary line time. In embodiments in which the release time of a modulator is greater than the actuation time, the release voltage may be applied for longer than a single line time, as depicted in FIG. 5B. In further embodiments, voltages applied along common lines or segment lines may vary to account for variations in the actuation and release voltages of different modulators, such as modulators of different colors.

Figure 6A:
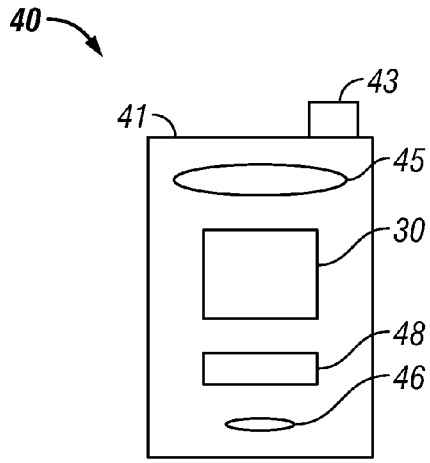
FIGS. 6A and 6B are system block diagrams illustrating an embodiment of a visual display device comprising a plurality of interferometric modulators.
Figure 6B:
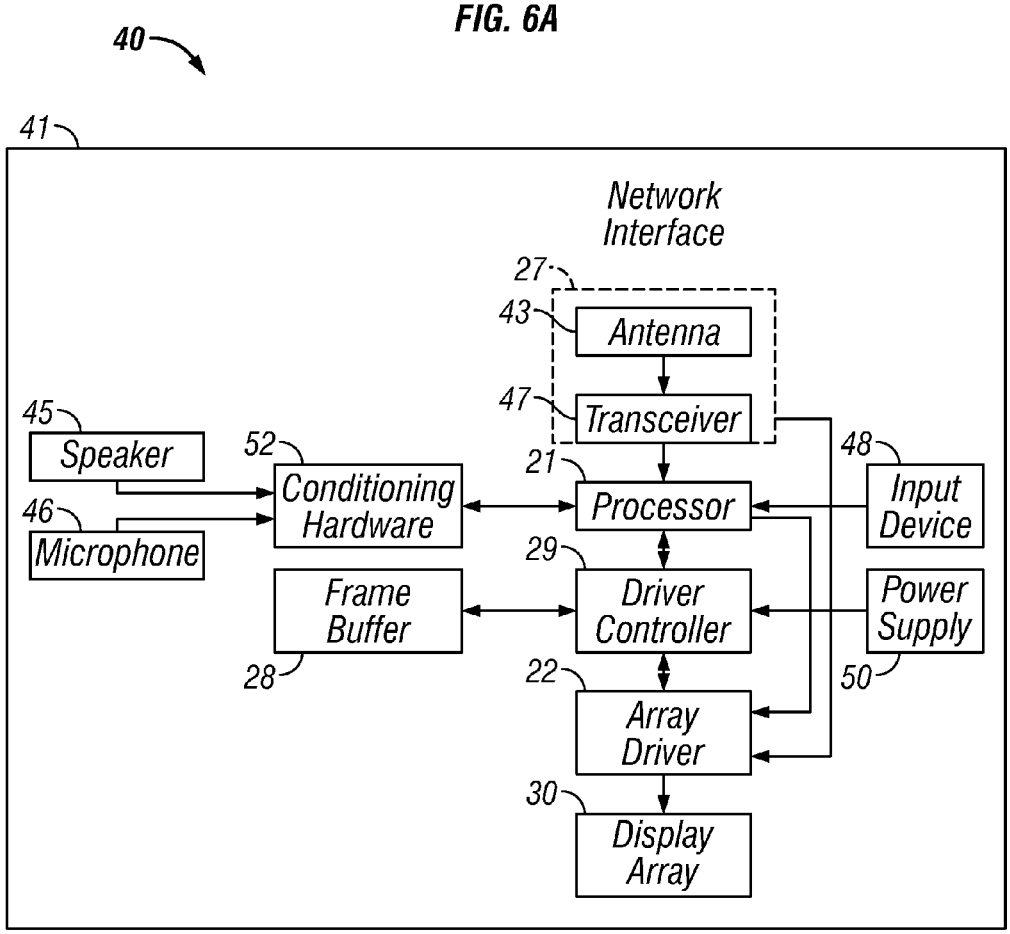

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 45, an input device 48, and a microphone 46. The housing 41 is generally formed from any of a variety of manufacturing processes, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one or more devices over a network. In one embodiment the network interface 27 may also have some processing capabilities to relieve requirements of the processor 21. The antenna 43 is any antenna for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS, W-CDMA, or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. The above-described optimization may be implemented in any number of hardware and/or software components and in various configurations.

Figure 7A:
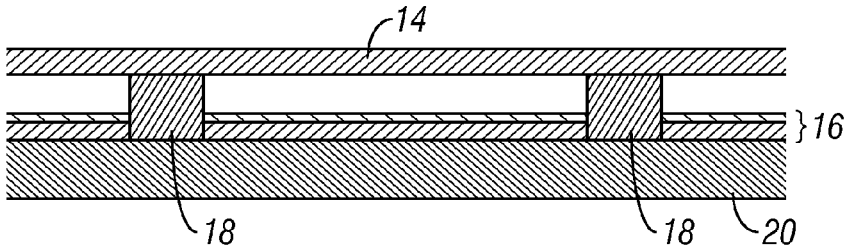
FIG. 7A is a cross section of the device of FIG. 1.
Figure 7B:
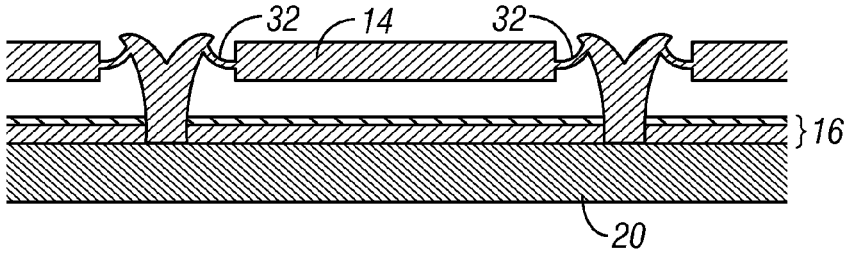
FIG. 7B is a cross section of an alternative embodiment of an interferometric modulator.
Figure 7C:
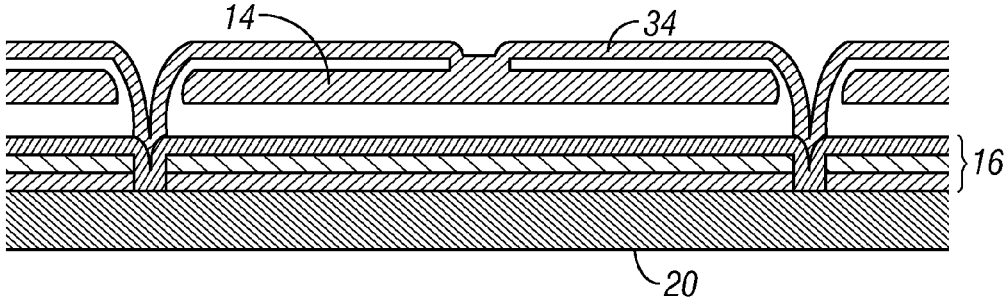
FIG. 7C is a cross section of another alternative embodiment of an interferometric modulator.
Figure 7D:
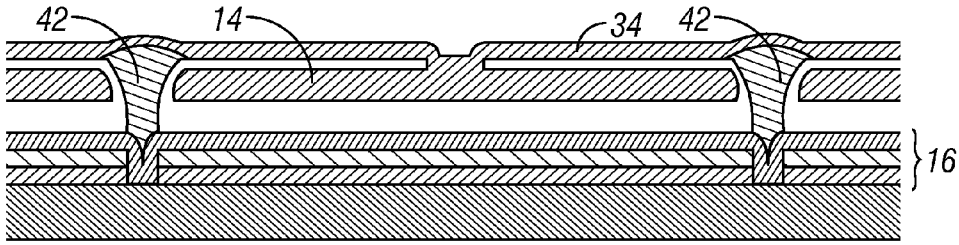
FIG. 7D is a cross section of yet another alternative embodiment of an interferometric modulator.
Figure 7E:
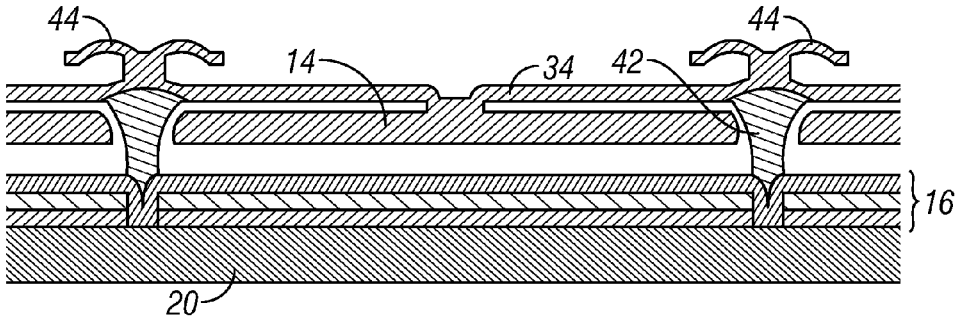
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 of each interferometric modulator is square or rectangular in shape and attached to supports at the corners only, on tethers 32. In FIG. 7C, the moveable reflective layer 14 is square or rectangular in shape and suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the gap, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. For example, such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

Some of the embodiments of the invention relate to hardware used to generate the common line voltage waveforms illustrated in FIG. 5B. As shown in FIG. 5B and described above, each common line may, at different times, may be at one of five or more voltage levels. In particular, each common line may be at a high or low hold voltage, a high or low address voltage, or a ground voltage level. In one embodiment, the hardware required to drive each common line between theses voltage levels is reduced according to the systems and methods described herein. Advantageously, this reduction in hardware per common line reduces the overall size, cost, and complexity of the driving circuitry.

Figure 8:
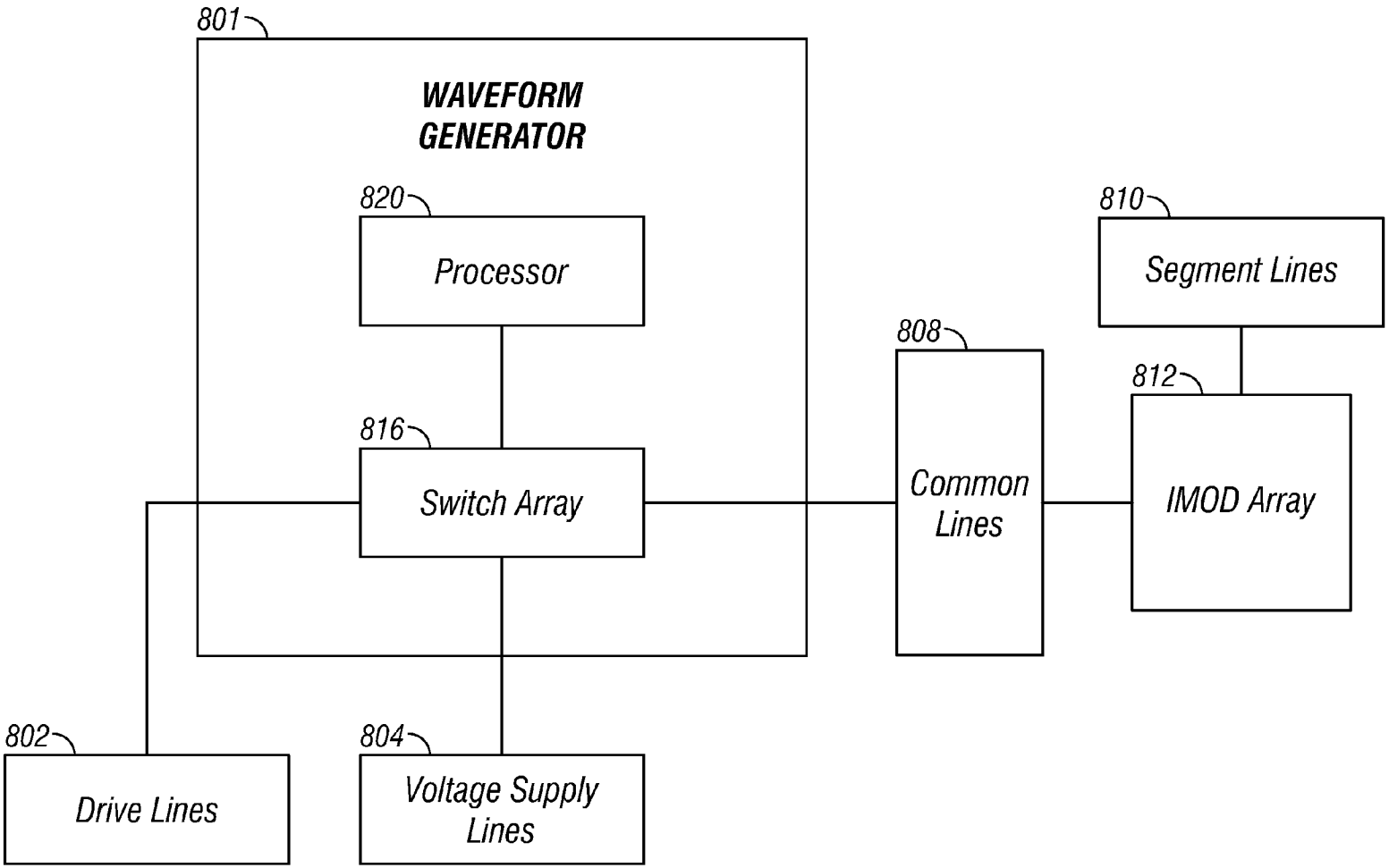
FIG. 8 is a system block diagram row driver circuit and IMOD array of FIG. 2.

FIG. 8 is a system block diagram of the row driver circuit 24 and display array 30 of FIG. 2. FIG. 8 illustrates a waveform generator 801. The waveform generator 801 may perform the function of row driver circuit 24 of FIG. 2. In particular, the waveform generator 801 may generate the common line voltage waveforms depicted in FIG. 5B and couple the common line voltage waveforms to common lines 808 in order to facilitate the operation of the IMOD array 812. The waveform generator 801 may be coupled to one or more drive lines 802, voltage supply lines 804, and common lines 808. In one embodiment, the waveform generator 801 may generate the common line voltage waveforms by selectively coupling the drive lines 802 to the voltage supply lines 804. The waveform generator 801 may also selectively couple the drive lines 802 or voltage supply lines 804 to the common lines 808. The segment lines 810 may be driven as described above with respect to FIG. 2-5. The coordinated driving of the common lines 808 and segment lines 810 may combine to operate the IMOD array 812.

The waveform generator 801 may comprise a switch array 816. The switch array 816 may comprise one or more individual switch devices (not shown). The switch array 816 may be coupled to the drive lines 802, voltage supply lines 804, and common lines 808. The individual switch devices of the switch array 816 may be configured to couple the drive lines 802 to the voltage supply lines 804, the drive lines 802 to the common lines 808, or the voltage supply lines 804 to the common lines 808. Exemplary details of various configurations will be described in greater detail below. The waveform generator 801 further comprises a processor 820 coupled to the switch array 816. The processor 820 may comprise control logic for directing the operation of the switch array 816. In particular, the processor 820 may be configured to activate or deactivate each individual switching device in the switch array 816. The processor 820 may also be coupled to another processor such as the processor 21 of FIG. 2 (not shown). The processor 820 may receive communications from the processor 21 and interpret those communications as instructions for controlling the operation of the switch array 816.

Figure 9:
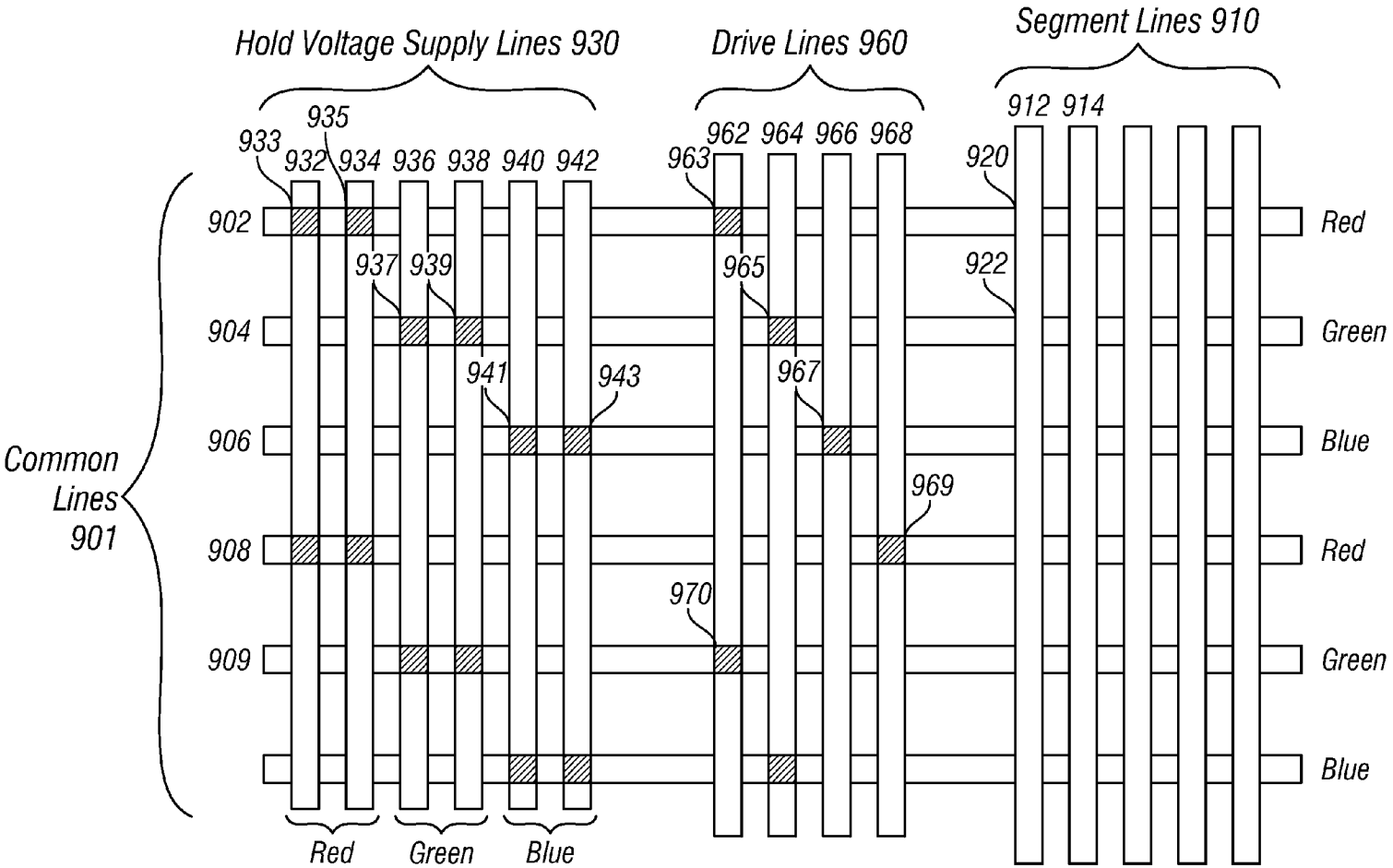
FIG. 9 is a block diagram of a portion of a switch array and IMOD array of FIG. 8.

FIG. 9 is a block diagram of a portion of a switch array and IMOD array of FIG. 8. FIG. 9 illustrates a plurality of common lines 901 including common lines 902, 904, 906, 908, and 909. Each common line may be associated with a particular color. The interferometric modulators on each row may configured to selectively reflect light having wavelengths associated with the color of each row. For example, the IMODs in a row 902 may be configured to reflect light having wavelengths associated with the color red. For example, common line 902 may be associated with the color red, common line 904 may be associated with the color green, and common line 906 may be associated with the color blue. This pattern may continue such that the next common line 908 is associated with red, the next common line 909 is associated with green, and so on. The common lines 901 are similar to the common lines 808 of FIG. 8 and the rows of display array 30 of FIG. 2. FIG. 9 further illustrates a plurality of segment lines 910 including segment lines 912 and 914. The segment lines 910 are similar to segment lines 810 of FIG. 8 and the columns of display array 30 of FIG. 2. As described above, an individual IMOD device may be positioned at the intersection of the common lines 901 and segment lines 910. Thus an IMOD 920 may be located at the intersection of the common line 902 and the segment line 910. Similarly, an IMOD 922 may be located at the intersection of the common line 904 and the segment line 912.

FIG. 9 further illustrates a plurality of hold voltage supply lines 930 including hold voltage supply lines 932, 934, 936, 938, 940, and 942. The hold voltage supply lines 930 are a subset of the voltage supply lines 804 of FIG. 8. As described above, each of the common lines 901 may be connected to two separate hold voltage levels, a positive hold voltage and a negative hold voltage. Further, as described above, each of the common lines 901 may be associated with a particular color such as red, green, or blue. IMODs associated with one of the colors, such as red, may require a different set of hold voltages from the other colors, such as green or blue. Thus, six different hold voltage supply lines 932, 934, 936, 938, 940, and 942 are provided. The number of hold voltage supply lines 930 may increase or decrease depending on the number of colors, the number of hold voltages per color, the similarity of the hold voltages between colors, or other factors. In this example, hold voltage supply lines 932 and 934 respectively provide positive and negative red hold voltages, the hold voltage supply lines 936 and 938 respectively provide positive and negative green hold voltages, and the hold voltage supply lines 940 and 942 respectively provide positive and negative blue hold voltages.

A selective coupling switch (or switch) may be provided at or near the intersection of each common line 901 and hold voltage supply line 930 associated with a same color. Thus, switches 933 and 935 are respectively provided near the intersection of red common line 902 and red hold voltage supply lines 932 and 934. Similarly, switches 937 and 939 are respectively provided near the intersection of green common line 904 and green hold voltage supply lines 936 and 938. Further, switches 941 and 943 are respectively provided near the intersection of blue common line 906 and blue hold voltage supply lines 941 and 943. The switches may form part of the switch array 816 of FIG. 8. Each selective coupling switch may be configured to electrically couple the two lines with which it is associated. For example, the switch 933 may couple the red positive hold voltage supply line 932 to the red common line 902. In this manner the red common line 902 may be driven to the red positive hold voltage level. Other lines may be driven to other hold voltages in a similar manner. A switch may be described as active when it is coupling two lines. Conversely, a switch may be described as inactive when it is not coupling two lines.

FIG. 9 further illustrates a plurality of drive lines 960 including drive lines 962, 964, 966, and 968. The drive lines 960 are similar to the drive lines 802 of FIG. 8. As illustrated, selective coupling switches (switches) may be provided so as to couple certain drive lines 960 and common lines 901. In particular, switches, such as switch 963, may be provided to couple one of the common lines 901, such as the common line 902, to one of the drive lines 960, such as the drive line 962. Similarly, common lines 904, 906, and 908 are configured to be coupled to drive lines 964, 966, and 968 by switches 965, 967 and 969 respectively. For ease of explanation, this pattern of switches connecting sequential common lines 901 to sequential drive lines 960 may be referred to as a cascading pattern. As illustrated, the number of common lines 901 may exceed the number of drive lines 960. Thus, the cascading pattern may repeat periodically. For example, the common line 909 may be selectively coupled to the drive line 962 by the switch 970. This cascading pattern may be repeated for the remainder of the common lines 901. Other patterns may also be used.

As described in detail below, each of the drive lines 960 may be driven to a plurality of voltage levels, such as hold voltage levels, address voltage levels, and ground level, used to operate the IMOD devices, such as IMODS 920, and 922. Thus, in the present configuration, each common line, such as the common line 902, may be driven to any of the voltage levels and may be held at either of the corresponding hold voltage levels by selective manipulation of only three switches, in this example switches 933, 935, and 963. This advantageous configuration reduces the number of switches per common line required to generate the waveforms described above with respect to FIG. 5B. Thus, the size, complexity, and cost of the driving circuitry for each common line and thus the circuit overall are reduced.

Figure 10:
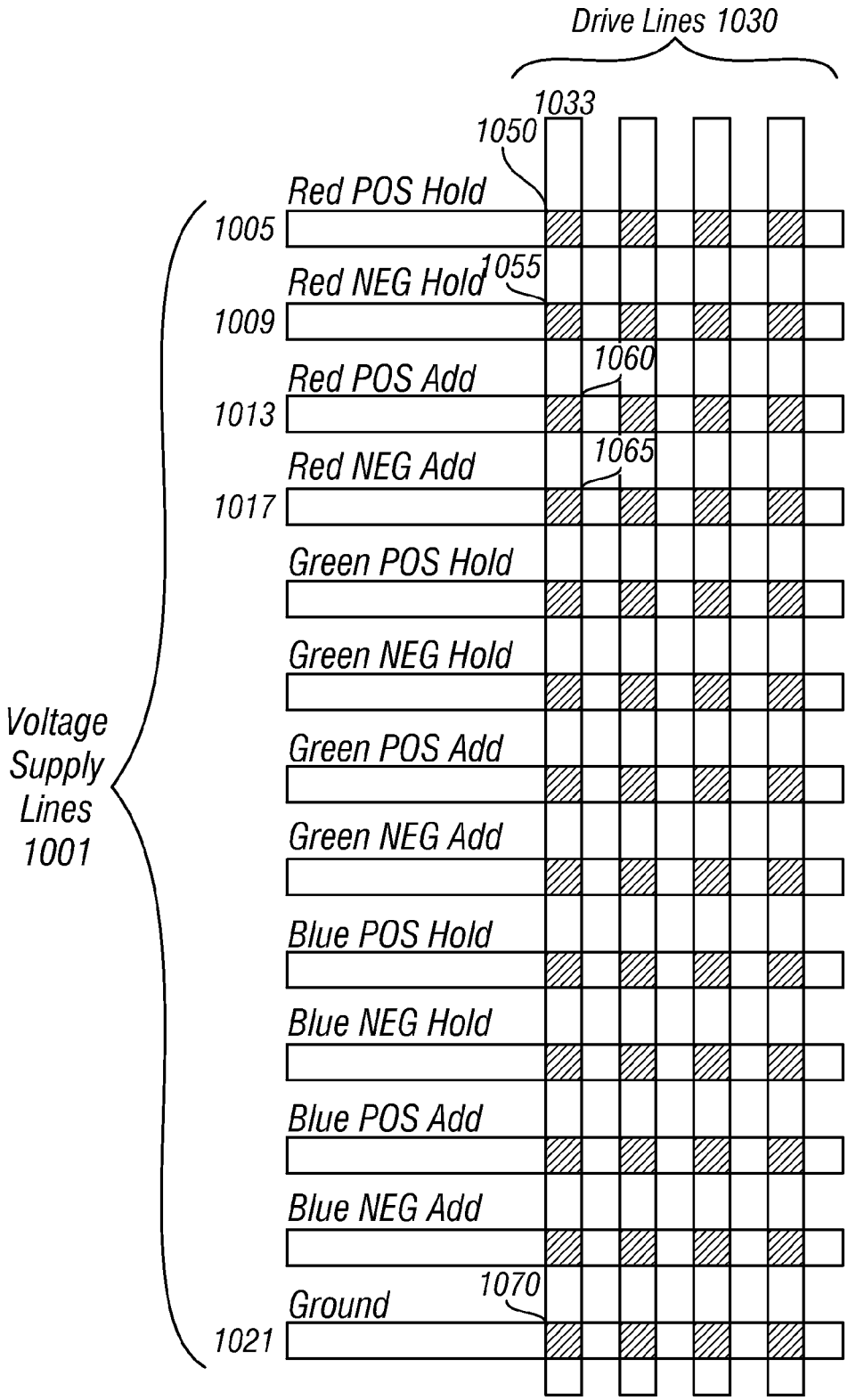
FIG. 10 is a block diagram of another portion of a switch array of FIG. 8.

FIG. 10 is a block diagram of another portion of a switch array of FIG. 8. FIG. 10 illustrates a number of voltage supply lines 1001. The voltage supply lines 1001 are similar to the voltage supply lines 804 of FIG. 8. The illustrated voltage supply lines 1001 include red positive hold line 1005, red negative hold line 1009, red positive address line 1013, red negative address line 1017, and ground line 1021. The red positive hold line 1005 and the red negative hold line 1009 are similar to the hold voltage lines 932 and 934 of FIG. 9. The positive and negative, hold and address lines for green and blue are also illustrated. FIG. 10 also depicts a plurality of drive lines 1030 including drive line 1033. The drive lines 1030 are similar to the drive lines 802 of FIG. 8 and 960 of FIG. 9. FIG. 10 also illustrates a plurality of selective coupling switches (switches) including switches 1050, 1055, 1060, 1065, and 1070. In one embodiment, switches are provided for coupling each of the drive lines 1030, such as drive line 1033, to each of the voltage supply lines 1001. As described in greater detail below, by selective manipulation of the switches, each of the drive lines 1030 can be driven to any of the voltage levels required to drive the common lines of the IMOD array. In particular, the switches can be manipulated to generate the common line voltage waveforms described above with respect to FIG. 5B.

Figure 11:
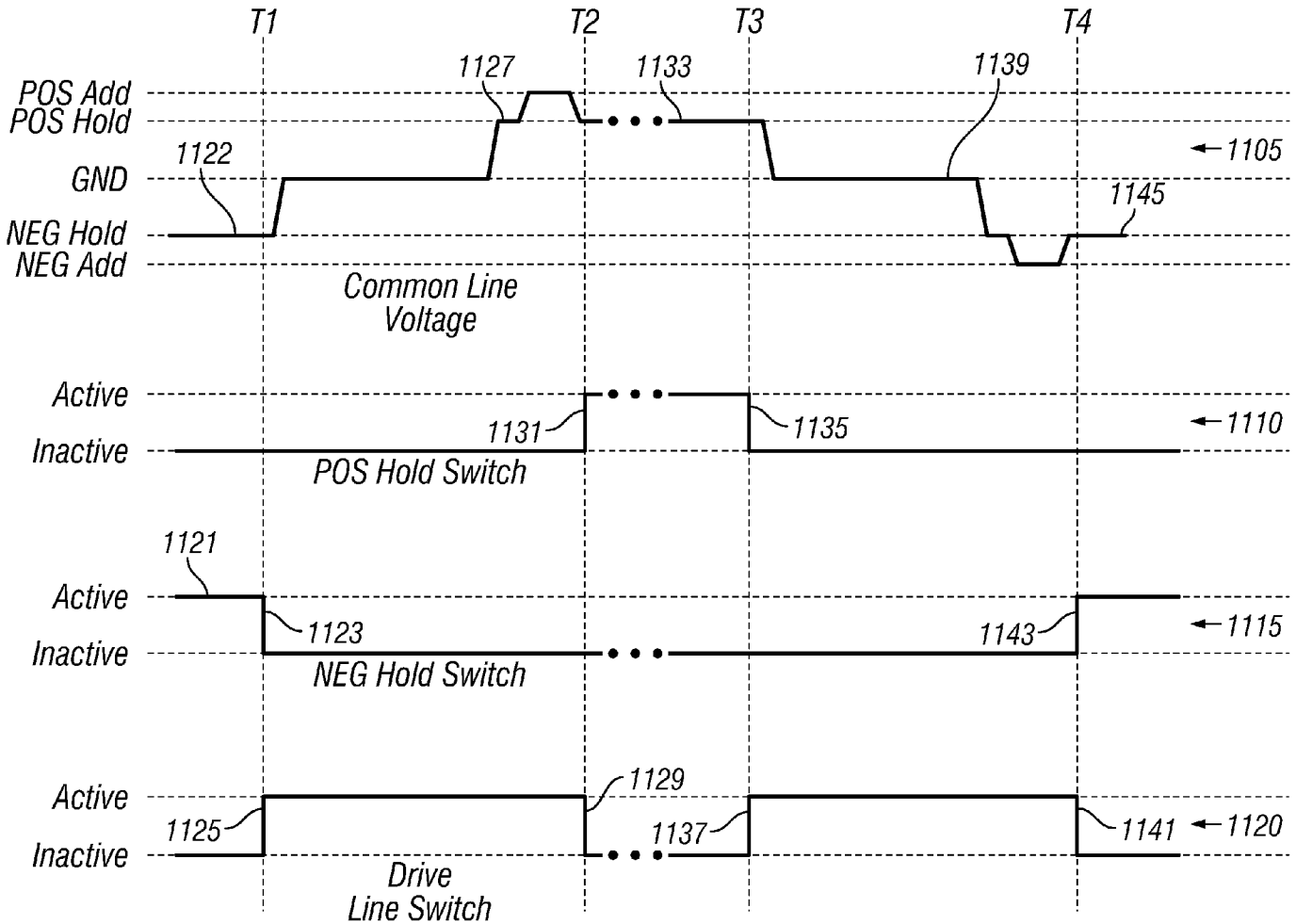
FIG. 11 is an exemplary timing diagram illustrating the operation of a portion of a switch array of FIG. 8.

FIG. 11 is an exemplary timing diagram illustrating the operation of a portion of a switch array of FIG. 8 and FIG. 9. Waveform 1105 represents the voltage level over time on a common line, such as common line 902 of FIG. 9. As depicted, the common line voltage may change between multiple distinct levels. In one embodiment, the common line voltage may change between a positive address voltage level, a positive hold voltage level, a ground voltage level, a negative hold voltage level, and a negative address voltage level. As discussed above with respect to FIGS. 5*a* and 5*b*, these voltage levels may be used in coordination to drive an IMOD display. While each common line may be configured to make use of these five voltage levels, the precise voltage values for each common line may vary. For example, as described above, each common line may be associated with a particular color, such as red, green, or blue. In one embodiment, the voltage levels for common lines associated with different colors may use different voltage values. Thus, the positive hold voltage for a green common line may not be the same as the positive hold voltage for a red common line. Indeed, in some circumstances, the positive hold voltage for two common lines of the same color may differ. However, for the sake of explanation, common lines will be described in terms of logical voltage levels illustrated in FIG. 11 and listed above.

FIG. 11 also illustrates a positive hold switch waveform 1110. Positive hold switch waveform 1110 may represent the behavior of a switch, such as switch 933 of FIG. 9, over time. As indicated, positive hold switch waveform 1110 may vary between an active and an inactive state. The active state may refer to a state in witch a switch is coupling a common line to a particular voltage line. Thus, when positive hold switch waveform 1110 indicates an active state, the common line may be coupled to a positive hold voltage supply line such as line 932 of FIG. 9. The inactive state may refer to a state in witch a switch is not coupling the common line to a particular voltage line. Thus, when positive hold switch waveform 1110 indicates an inactive state, the positive hold switch may not significantly affect the voltage level on the common line. FIG. 11 also depicts a negative hold switch waveform 1115. Negative hold switch waveform 1115 may represent the behavior of a switch, such as switch 935 of FIG. 9, over time. As with waveform 1110, the active and inactive states of waveform 1115 refer to whether or not a switch, such as switch 935, is coupling the common line to a particular voltage supply line. However, in the case of negative hold switch waveform 1115, the supply voltage line in question is a negative hold voltage supply line, such as supply line 934 of FIG. 9. FIG. 11 also illustrates a drive line switch waveform 1120. Drive line switch waveform 1120 may represent the behavior of a switch, such as switch 963 of FIG. 9, over time. As with waveforms 1110 and 1115, the active and inactive states of waveform 1120 refer to whether or not a switch, such as switch 963, is coupling the common line to a particular voltage line. With respect to waveform 1120, the voltage line may be a drive line such as drive line 962 of FIG. 9.

FIG. 11 illustrates an exemplary relationship between the activity levels of common line switches, such as switches 933, 935, and 963 of FIG. 9, and the voltage level on a common line, such as common line 902. In one example, prior to a time T1, the negative hold switch is active as shown by waveform segment 1121 and the common line is steady at the negative hold voltage level as shown by waveform segment 1122. At time T1, the negative hold switch changes to an inactive state as shown by waveform segment 1123 and the drive line switch changes to an active state as shown by waveform segment 1125. In reference to the elements of FIG. 9, this means that switch 935 goes inactive, decoupling common line 902 from the negative voltage supply line 934. Further, switch 963 goes active coupling the common line 902 to the drive line 962. Between, time T1 and time T2, the common line voltage level varies as shown by waveform segment 1127 according to the voltage on the drive line. At time T2, the drive line switch reverts to an inactive state as shown by waveform segment 1129 and the positive hold voltage switch changes to an active state as shown by waveform segment 1131. Again, with reference to FIG. 9, this means that switch 963 decouples the common line 902 from the drive line 962 and that switch 933 couple the common line to positive hold voltage supply line 932. As a result, the common line voltage is held at the positive hold voltage level as shown by waveform segment 1133 between times T2 and T3. At time T3, the positive hold switch changes back to the inactive state as shown by waveform segment 1135 and the drive line switch reverts to an active state as shown by waveform segment 1137. Thus, between times T3 and T4, the voltage on the common line varies between levels as shown by waveform segment 1139 according to the voltage on the drive line. At time T4, the drive line switch changes from the active state to an inactive state as shown by waveform segment 1141 and the negative hold switch changes from inactive to active as shown by waveform segment 1143. The common line voltage is thus held at the negative hold voltage level as shown by waveform segment 1145.

While depicted as occurring simultaneously, in general, the activity levels of the switches may change at approximately the same time or at staggered times in either order. Similarly, the transitions between the voltage levels of the common line voltage are shown as being linear and gradual for the purpose of explanation and do not necessarily represent actual voltage transitions in hardware.

Advantageously, the present embodiment allows the common line voltage waveform 1105 to vary between five different voltage levels during active times and to hold steady at either of two distinct voltage levels during inactive times using only three switches for the common line. This small number of switches per common line results in a decrease in chip size.

Figure 12:
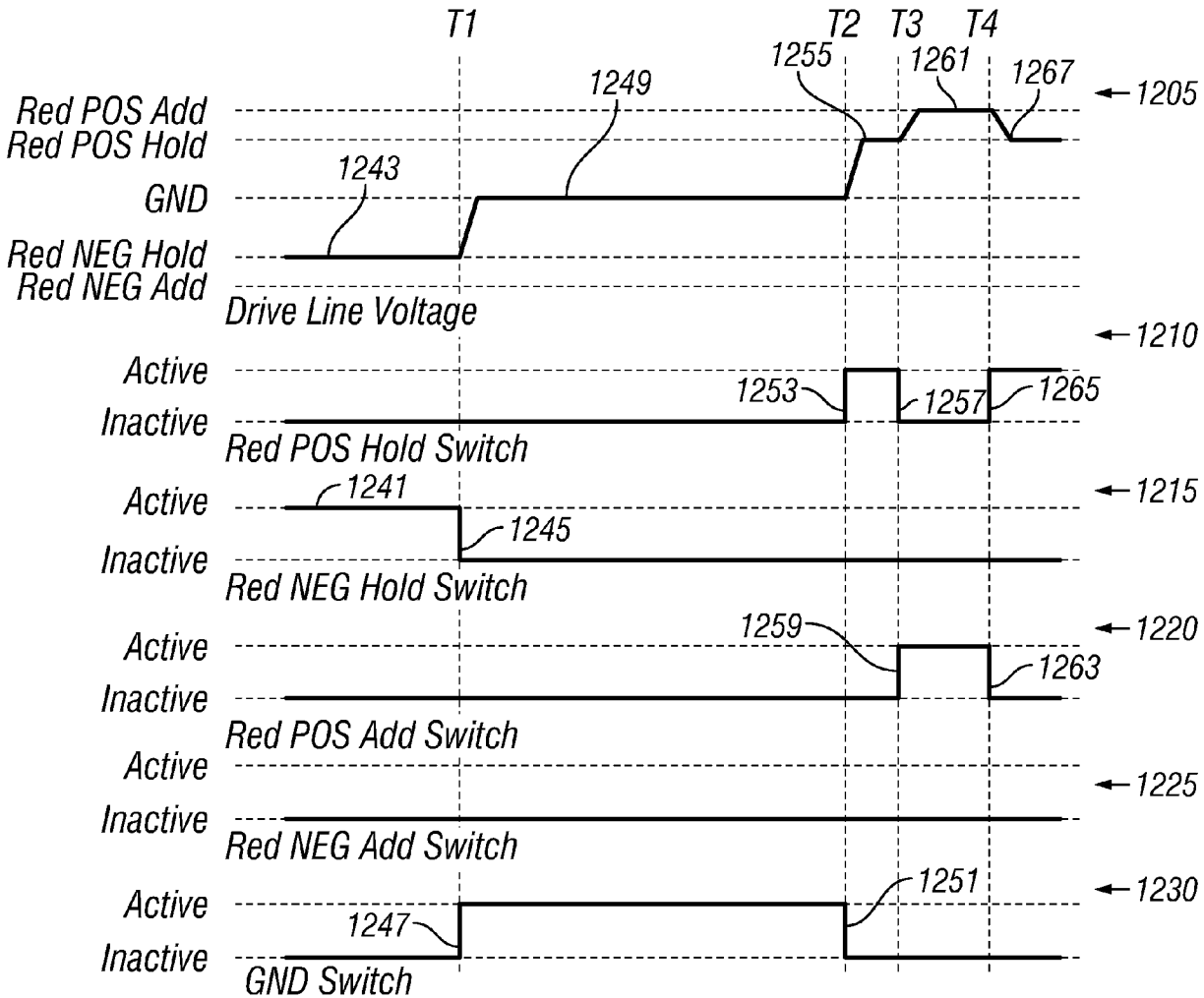
FIG. 12 is another exemplary timing diagram illustrating the operation of a portion of a switch array of FIG. 8.

FIG. 12 is another exemplary timing diagram illustrating the operation of a portion of a switch array of FIG. 8 and FIG. 10. Waveform 1205 represents the voltage level over time on a drive line, such as drive line 1033 of FIG. 10 or drive line 962 of FIG. 9. As depicted, the drive line voltage may change between multiple distinct levels. In one embodiment, the drive line voltage may change between a positive address voltage level, a positive hold voltage level, a ground voltage level, a negative hold voltage level, and a negative address voltage level. As discussed above with respect to FIGS. 5*a* and 5*b*, these voltage levels may be used in coordination to drive an IMOD display. Further, as described above, in some embodiments, each drive line may be used to drive common lines of each color. Thus, each drive line may be configured to change between a positive hold voltage, negative hold voltage, positive address voltage, and negative address voltage for each color. In addition, the drive lines may be configured to change to a ground voltage. In an embodiment using three colors, red, green, and blue, this configuration results in a possible 13 voltage levels for each drive line. Other voltage levels may also be used. In other embodiments, the number and configuration of drive lines may be selected such that each drive line is only used for driving common lines of the same color. For example, the number of drive lines may be a multiple of the number of colors. In this embodiment, each drive line might only be configured to vary between a subset of the possible voltage levels instead of being capable of producing every voltage level for any color. For the purposes of explanation, the waveform 1205 represents the voltage of a drive line during a time when it is being used to drive a common line associated with the color red.

FIG. 12 also illustrates a red positive hold switch waveform 1210. Red positive hold switch waveform 1210 may represent the behavior of a switch, such as switch 1050 of FIG. 10, over time. As indicated, red positive hold switch waveform 1210 may vary between an active and an inactive state. The active state may refer to a state in witch a switch is coupling a drive line to a particular voltage supply line. Thus, when positive hold switch waveform 1210 indicates an active state, the drive line may be coupled to a positive hold voltage supply line such as line 1005 of FIG. 10. The inactive state may refer to a state in witch a switch is not coupling the drive line to a particular voltage line. Thus, when red positive hold switch waveform 1210 indicates an inactive state, the positive hold switch may not significantly affect the voltage level on the drive line. FIG. 12 also depicts a red negative hold switch waveform 1215. Red negative hold switch waveform 1215 may represent the behavior of a switch, such as switch 1055 of FIG. 10, over time. As with waveform 1210, the active and inactive states of waveform 1215 refer to whether or not a switch, such as switch 1055 of FIG. 10, is coupling the drive line to a particular voltage supply line. However, in the case of red negative hold switch waveform 1215, the supply voltage line in question is a red negative hold voltage supply line, such as supply line 1009 of FIG. 10.

FIG. 12 also depicts a red positive address switch waveform 1220. Red positive address switch waveform 1220 may represent the behavior of a switch, such as switch 1060 of FIG. 10, over time. As with waveform 1210, the active and inactive states of waveform 1220 refer to whether or not a switch, such as switch 1060 of FIG. 10, is coupling the drive line to a particular voltage supply line. However, in the case of red positive address switch waveform 1220, the supply voltage line in question is a red positive address supply line, such as supply line 1013 of FIG. 10. FIG. 12 further depicts a red negative address switch waveform 1225. Red negative address switch waveform 1225 may represent the behavior of a switch, such as switch 1065 of FIG. 10, over time. As with waveform 1210, the active and inactive states of waveform 1225 refer to whether or not a switch, such as switch 1065 of FIG. 10, is coupling the drive line to a particular voltage supply line. In the case of red negative address switch waveform 1225, the supply voltage line in question is a red negative address supply line, such as supply line 1017 of FIG. 10. FIG. 12 also illustrates a ground switch waveform 1230. Ground switch waveform 1230 may represent the behavior of a switch, such as switch 1070 of FIG. 10, over time. As with waveform 1210, the active and inactive states of waveform 1230 may refer to whether or not a switch, such as switch 1070 of FIG. 10, is coupling the drive to a particular voltage supply line. With respect to waveform 1230, the voltage supply line may be a ground voltage supply line such as ground voltage supply line 1021 of FIG. 10.

FIG. 12 illustrates an exemplary relationship between the activity levels of drive line switches, such as switches 1050, 1055, 1060, 1065, and 1070 of FIG. 10, and the voltage level on a drive line, such as the drive line 1033 of FIG. 10 or 962 of FIG. 9. In one example, prior to a time T1, the red negative hold switch is active as shown by waveform segment 1241 and the drive line voltage is steady at the red negative hold voltage level as shown by waveform segment 1243. At time T1, the red negative hold switch changes to an inactive state as shown by waveform segment 1245 and the ground switch changes to an active state as shown by waveform segment 1247. In reference to the elements of FIG. 10, this means that switch 1055 goes inactive, decoupling drive line 1033 from the red negative hold voltage supply line 1009. Further, switch 1070 goes active coupling the drive line 1033 to the ground voltage supply line 1021. Between, time T1 and time T2, the drive line voltage level is held at the ground voltage level as shown by waveform segment 1249. At time T2, the ground switch reverts to an inactive state as shown by waveform segment 1251 and the red positive hold voltage switch changes to an active state as shown by waveform segment 1253. Again, with reference to FIG. 10, this means that switch 1070 decouples the drive line 1033 from the ground voltage supply line 1021 and that switch 1050 couples the drive line to red positive hold voltage supply line 1005. As a result, the drive line voltage is raised to, and held at, the positive hold voltage level between times T2 and T3 as shown by waveform segment 1255. At time T3, the red positive hold switch reverts to an inactive state as shown by waveform segment 1257 and the red positive address voltage switch changes to an active state as shown by waveform segment 1259. Again, with reference to FIG. 10, this means that switch 1050 decouples the drive line 1033 from the red positive hold voltage supply line 1005 and that switch 1060 couples the drive line to red positive address voltage supply line 1013. As a result, the drive line voltage is raised to, and held at, the positive address voltage level between times T3 and T4 as shown by waveform segment 1261. At time T4, the red positive address switch changes back to the inactive state as shown by waveform segment 1263 and the red positive hold switch reverts to an active state as shown by waveform segment 1265. Thus, after time T4, the voltage on the drive line reverts to the red positive hold voltage level as shown by waveform segment 1267.

While depicted as occurring simultaneously, in general, the activity levels of the switches may change at approximately the same time or at staggered times in either order. Similarly, the transitions between the voltage levels of the drive line voltage are shown as being linear and gradual for the purpose of explanation and do not necessarily represent actual voltage transitions in hardware.

Advantageously, the present embodiment allows the common line voltage to be set to any of the voltages required to drive the common line by generating the voltage levels on the drive and then coupling the drive line to the common line. In this manner, the circuitry used to generate the drive waveforms is implemented for a relatively small number of drive lines. Accordingly, the circuitry for the common lines can be significantly reduced in complexity and size.

Figure 13:
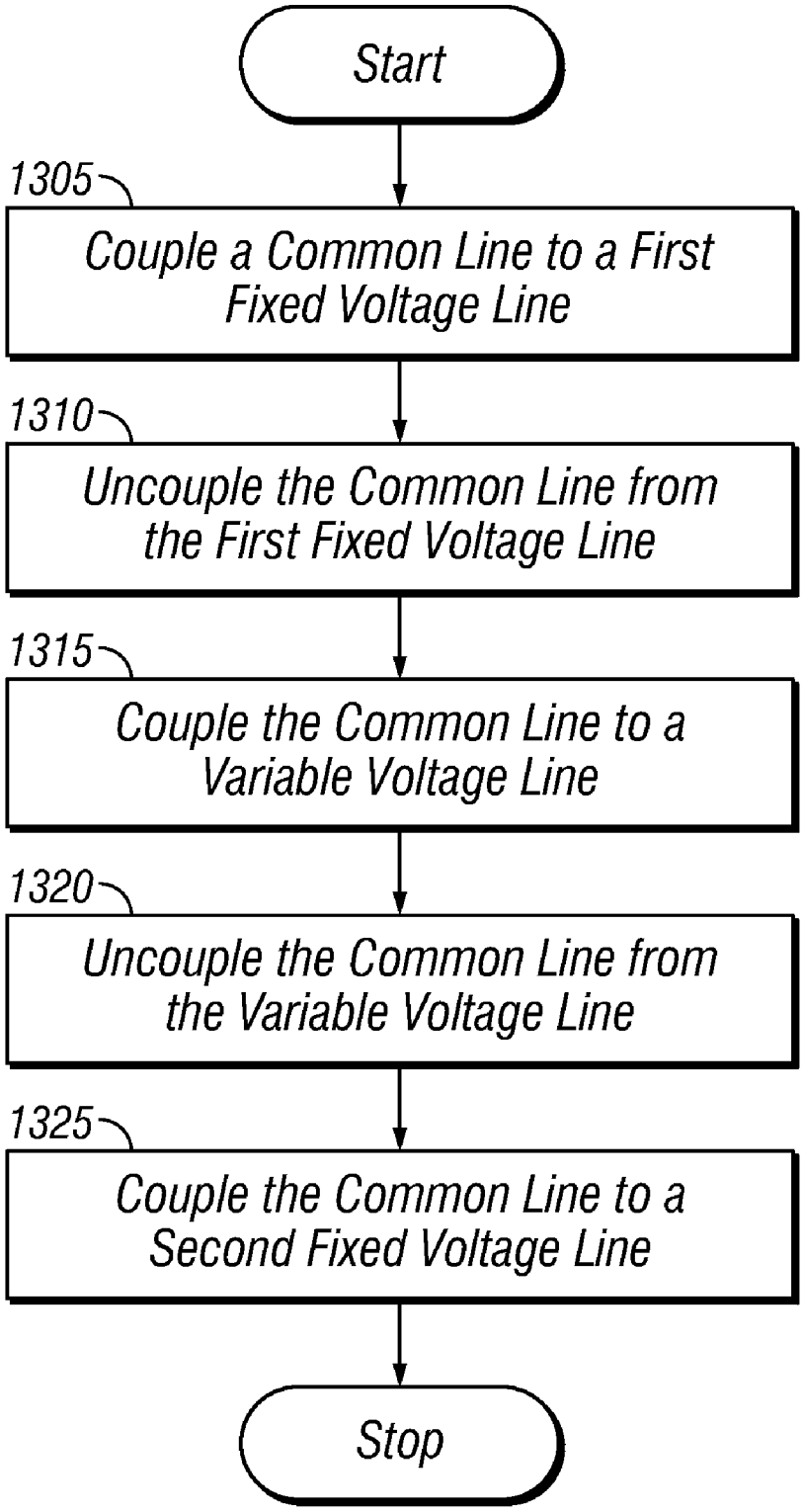
FIG. 13 is a flowchart of an embodiment of a process of driving common lines for an IMOD display.

FIG. 13 is a flowchart of an embodiment of a process 1300 of driving common lines for an IMOD display. For purposes of explanation, the process 1300 will be described in relation to elements depicted if FIG. 9. At step 1305, a common line, such as the common line 902 of FIG. 9, is coupled to a first fixed voltage line, such as red positive hold voltage supply line 932. In one embodiment, this coupling is performed by switch 933 of FIG. 9. As a result, the voltage on the common line may be held at the fixed voltage level. At step 1310, the common line, such as common line 902, is decoupled from the first fixed voltage line, such as red positive hold voltage supply line 932. At step 1315, the common line, such as common line 902, is coupled to a variable voltage line, such as drive line 962. In one embodiment, this coupling is performed by switch 963. As a result, the voltage on the common line may vary according to the voltage on the drive line as discussed above. At step 1320, the common line, such as common line 902, is uncoupled from the variable voltage line, such as drive line 962. At step 1325, the common line, such as common line 902, is coupled to a second fixed voltage line, such as red negative hold voltage supply line 934 of FIG. 9. In one embodiment, this coupling is performed by switch 935. As a result, the voltage on the common line is held at the second fixed voltage level. Advantageously, the present method enables the common lines of and IMOD display to be driven to any of the required voltage levels with a simplified coupling and decoupling scheme.

Figure 14:
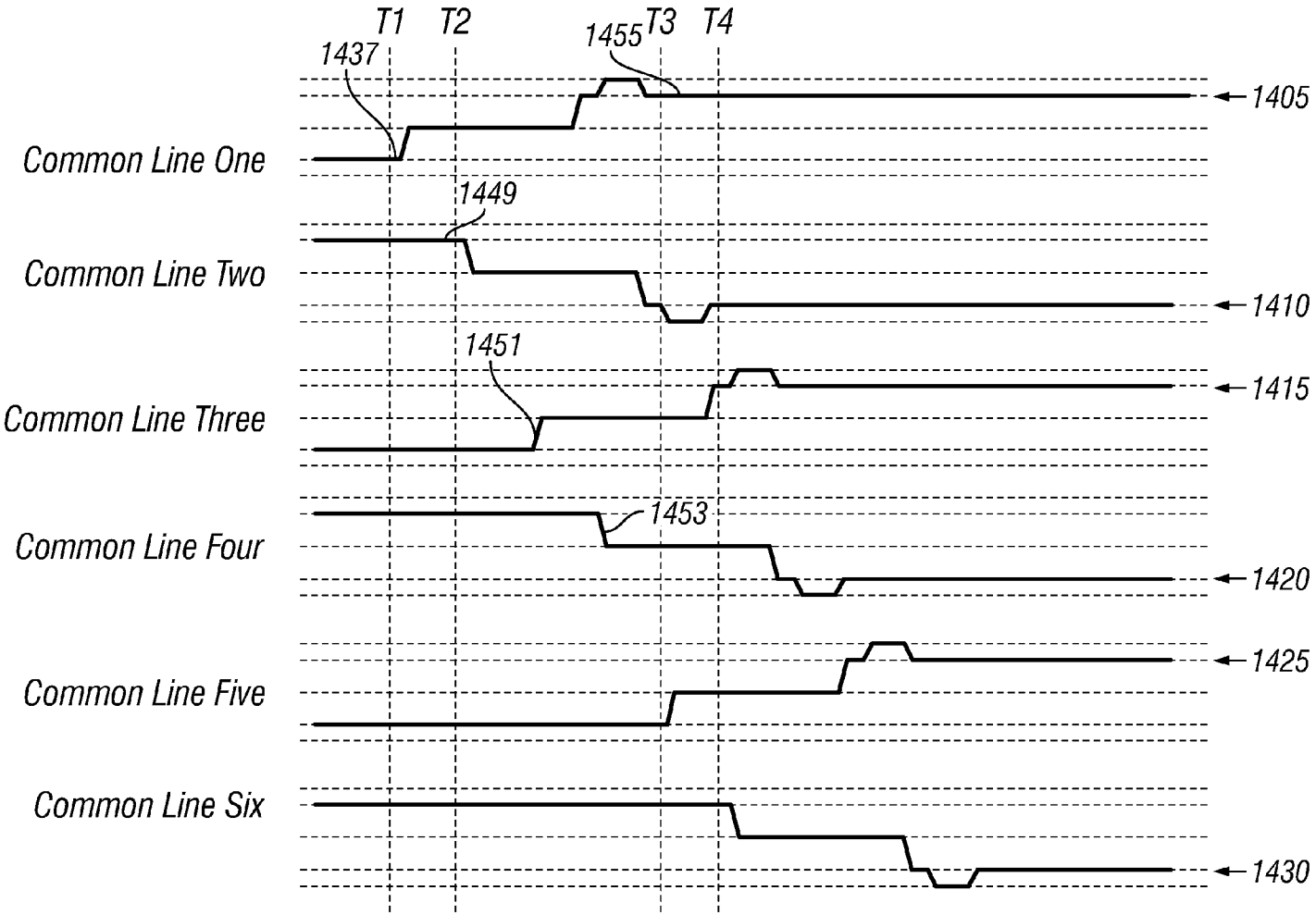
FIG. 14 is another exemplary timing diagram illustrating the operation of a waveform generator of FIG. 8.

FIG. 14 is another exemplary timing diagram illustrating the operation of a waveform generator of FIG. 8. FIG. 14 depicts the voltage level over time on a plurality of common lines. In particular, waveforms 1405, 1410, 1415, 1420, 1425, and 1430, represent the voltage levels on common lines one, two, three, four, five, and six respectively. The common lines of FIG. 14 are similar to the common lines 901 of FIG. 9. For example, common line one is similar to common line 902 of FIG. 9. Common line two is similar to common line 904. Common line three is similar to common line 906 an so on. As shown, the waveforms indicate a progression through a series of voltage levels corresponding to the voltage levels described above with respect to FIG. 5*b*. As illustrated in FIG. 9, the number of common lines may exceed the number of drive lines. For example, in FIG. 9, a set of four drive lines 960 are provided for a larger set of common lines 901. In one embodiment, the drive lines are shared by the common lines as described herein. At a time T1, common line one is coupled to a first drive line. With respect to FIG. 9, this may represent the switch 963 activating to couple the drive line 962 to the common line 902. As shown in waveform segment 1447, the voltage on common line one begins to progress through the voltage pattern described above with respect to FIG. 5*b*. At time T2, common line two is coupled to a second drive line. With respect to FIG. 9, this may represent the switch 965 activating to couple the drive line 964 to the common line 904. As shown in waveform segment 1449, the voltage on common line two begins to progress through the pattern described above. At various times, according to a timing scheme, common lines three and four are similarly coupled to respective third and fourth drive lines and their waveforms similarly begin to progress through the described pattern as shown in waveform segments 1451 and 1453 respectively. At a time T3 the voltage pattern is completed for common line one. Common line one is decoupled from the first drive line and coupled to a hold voltage supply line. The voltage on common line one remains steady as shown in waveform segment 1455. Thus, the first drive line is free to be reused. Accordingly, at time T3 common line five is coupled to the first drive line. With respect to FIG. 9, this may represent that switch 963 uncouple drive line 962 from common line 902 and that switch 933 couples common line 902 to positive hold voltage supply line 932. Switch 970 may the couple drive line 962 to common line 909. Similarly, at time T4, common line two has completed the waveform pattern and is coupled to a hold voltage supply line. Thus, the second drive line is reused to drive common line six. This pattern may repeat in the cascading manner illustrated in FIG. 14 and FIG. 9. Advantageously, in this manner, a relatively large number of common lines may be driven using only a small number of drive lines. Thus, the size and complexity of the circuitry responsible for generating the voltage pattern described above may be concentrated in a small number of drive lines while the circuitry of the large number of common lines may be reduced enormously. The result is a circuit with an overall smaller space requirement.

Figure 15:
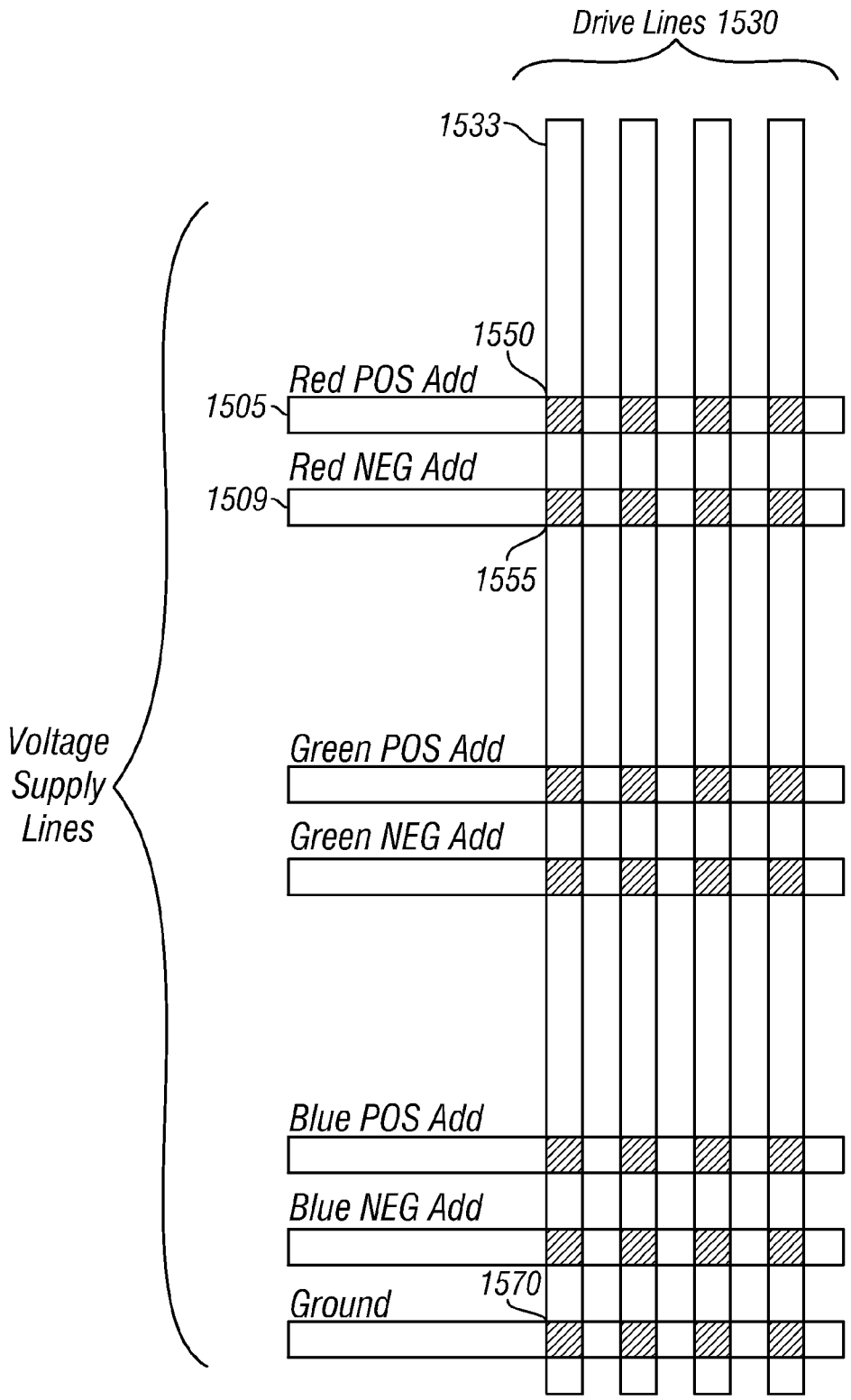
FIG. 15 is a block diagram of another portion of a switch array of FIG. 8.

FIG. 15 is a block diagram illustrating another embodiment of a portion of a switch array of FIG. 8. In particular, FIG. 15 describes an alternative to the switch array illustrated and described with respect to FIG. 10. As described above, the voltage wave from used to drive the common lines may comprise a plurality of voltage levels. In one embodiment, five voltage levels for any particular common line may be used: positive address, positive hold, ground, negative hold and negative address. The switch array of FIG. 10 illustrates that each drive line may be provided with switches for coupling each voltage level for each color. However, in another embodiment, only a subset of those switches and supply lines are provided. In particular, as illustrated in FIG. 15, all of the hold voltages may be omitted from illustrated switch array without compromising functionality described herein. As the hold voltages are already supplied at the common lines as described above, the hold voltages need not be supplied again to the drive lines. The corresponding changes to the control of the remaining voltage supply lines and switches are described herein with reference to FIGS. 15-17. FIG. 15 illustrates a number of voltage supply lines 1530. The voltage supply lines 1530 are similar to the voltage supply lines 804 of FIG. 8. The illustrated voltage supply lines 1530 include red positive address line 1505, red negative address line 1509, and ground line 1521. FIG. 15 also depicts a plurality of drive lines 1530 including drive line 1533. The drive lines 1530 are similar to the drive lines 802 of FIG. 8 and 960 of FIG. 9. FIG. 15 also illustrates a plurality of selective coupling switches including switches 1550, 1555, and 1070. In one embodiment, switches are provided for coupling each of the drive lines 1530, such as drive line 1533, to each of the voltage supply lines 1530. As described in greater detail below, by selective manipulation of the switches, each of the drive lines 1530 can be driven to certain of the voltage levels used to drive the common lines of the IMOD array. In particular, the switches can be manipulated to generate portions of the common line voltage waveforms described above with respect to FIG. 5B.

Figure 16:
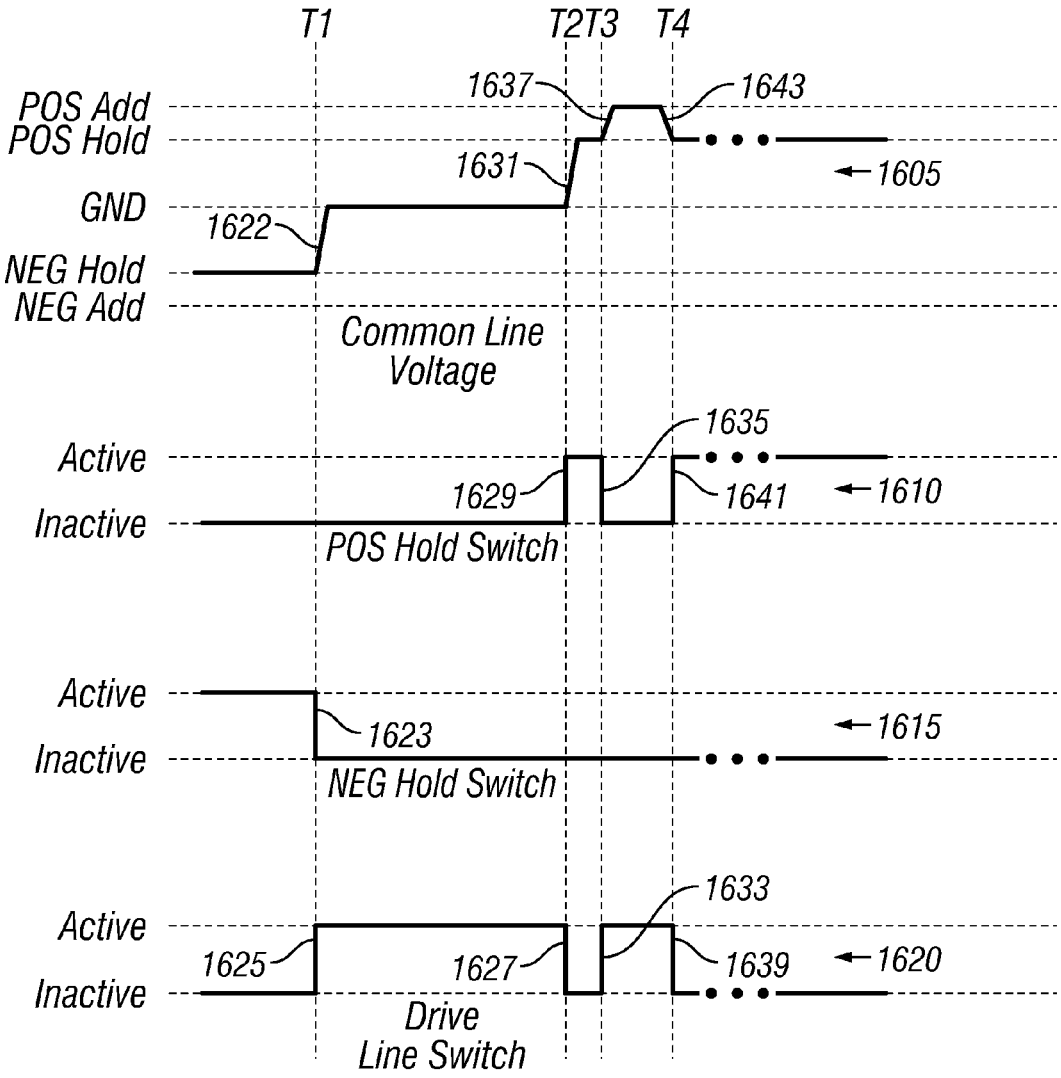
FIG. 16 is another exemplary timing diagram illustrating the operation of a portion of a switch array of FIG. 8.

FIG. 16 is an exemplary timing diagram illustrating the operation of a portion of a switch array of FIG. 8 and FIG. 9. FIG. 16 is similar to FIG. 11 in that it shows the operation of switches depicted in FIG. 9. However, FIG. 16 describes the operation of such switches in view of the configuration described with respect to FIG. 15. In particular, FIG. 16 represents the operation of such switches when the drive line does is not provided with hold voltage supply lines as shown in FIG. 15. In FIG. 16, waveform 1605 represents the voltage level over time on a common line, such as common line 902 of FIG. 9. As depicted, the common line voltage may change between multiple distinct levels. In one embodiment, the common line voltage may change between a positive address voltage level, a positive hold voltage level, a ground voltage level, a negative hold voltage level, and a negative address voltage level. As discussed above with respect to FIGS. 5*a* and 5*b*, these voltage levels may be used in coordination to drive an IMOD display. While each common line may be configured to make use of these five voltage levels, the precise voltage values for each common line may vary. For example, as described above, each common line may be associated with a particular color, such as red, green, or blue. In one embodiment, the voltage levels for common lines associated with different colors may use different voltage values. Thus, the positive hold voltage for a green common line may not be the same as the positive hold voltage for a red common line. Indeed, in some circumstances, the positive hold voltage for two common lines of the same color may differ. However, for the sake of explanation, common lines will be described in terms of logical voltage levels illustrated in FIG. 11 and listed above.

FIG. 16 also illustrates a positive hold switch waveform 1610. Positive hold switch waveform 1610 may represent the behavior of a switch, such as switch 933 of FIG. 9, over time. As indicated, positive hold switch waveform 1610 may vary between an active and an inactive state. The active state may refer to a state in witch a switch is coupling a common line to a particular voltage line. Thus, when positive hold switch waveform 1610 indicates an active state, the common line may be coupled to a positive hold voltage supply line such as line 932 of FIG. 9. The inactive state may refer to a state in witch a switch is not coupling the common line to a particular voltage line. Thus, when positive hold switch waveform 1610 indicates an inactive state, the positive hold switch may not significantly affect the voltage level on the common line. FIG. 16 also depicts a negative hold switch waveform 1615. Negative hold switch waveform 1615 may represent the behavior of a switch, such as switch 935 of FIG. 9, over time. As with waveform 1610, the active and inactive states of waveform 1615 refer to whether or not a switch, such as switch 935, is coupling the common line to a particular voltage supply line. However, in the case of negative hold switch waveform 1615, the supply voltage line in question is a negative hold voltage supply line, such as supply line 934 of FIG. 9. FIG. 16 also illustrates a drive line switch waveform 1620. Drive line switch waveform 1620 may represent the behavior of a switch, such as switch 963 of FIG. 9, over time. As with waveforms 1610 and 1615, the active and inactive states of waveform 1620 refer to whether or not a switch, such as switch 963, is coupling the common line to a particular voltage line. With respect to waveform 1620, the voltage line may be a drive line such as drive line 962 of FIG. 9.

FIG. 16 illustrates an exemplary relationship between the activity levels of common line switches, such as switches 933, 935, and 963 of FIG. 9, and the voltage level on a common line, such as common line 902. At time T1, the negative hold switch changes to an inactive state as shown by waveform segment 1623 and the drive line switch changes to an active state as shown by waveform segment 1625. In reference to the elements of FIG. 9, this means that switch 935 goes inactive, decoupling common line 902 from the negative voltage supply line 934. Further, switch 963 goes active coupling the common line 902 to the drive line 962. Between, time T1 and time T2, the common line voltage level varies as shown by waveform segment 1622 according to the voltage on the drive line. At time T2, the drive line switch reverts to an inactive state as shown by waveform segment 1627 and the positive hold voltage switch changes to an active state as shown by waveform segment 1629. Again, with reference to FIG. 9, this means that switch 963 decouples the common line 902 from the drive line 962 and that switch 933 couple the common line to positive hold voltage supply line 932. As a result, the common line voltage is held at the positive hold voltage level as shown by waveform segment 1631 between times T2 and T3. At time T3, the positive hold switch changes back to the inactive state as shown by waveform segment 1635 and the drive line switch reverts to an active state as shown by waveform segment 1633. Thus, between times T3 and T4, the voltage on the common line varies between levels as shown by waveform segment 1637 according to the voltage on the drive line. At time T4, the drive line switch changes from the active state to an inactive state as shown by waveform segment 1639 and the positive hold switch changes from inactive to active as shown by waveform segment 1641. The common line voltage is thus held at the positive hold voltage level as shown by waveform segment 1643.

As described with respect to FIG. 15, by using the positive and negative hold voltages already supplied to the common line, the driving voltage waveform may be generated without supplying the same hold voltages to the drive line directly. In this manner, the number of switches required to generate the waveform may be further reduced.

While depicted as occurring simultaneously or near simultaneously, in general, the activity levels of the switches may change at approximately the same time or at staggered times in either order. Similarly, the transitions between the voltage levels of the common line voltage are shown as being linear and gradual for the purpose of explanation and do not necessarily represent actual voltage transitions in hardware.

Figure 17:
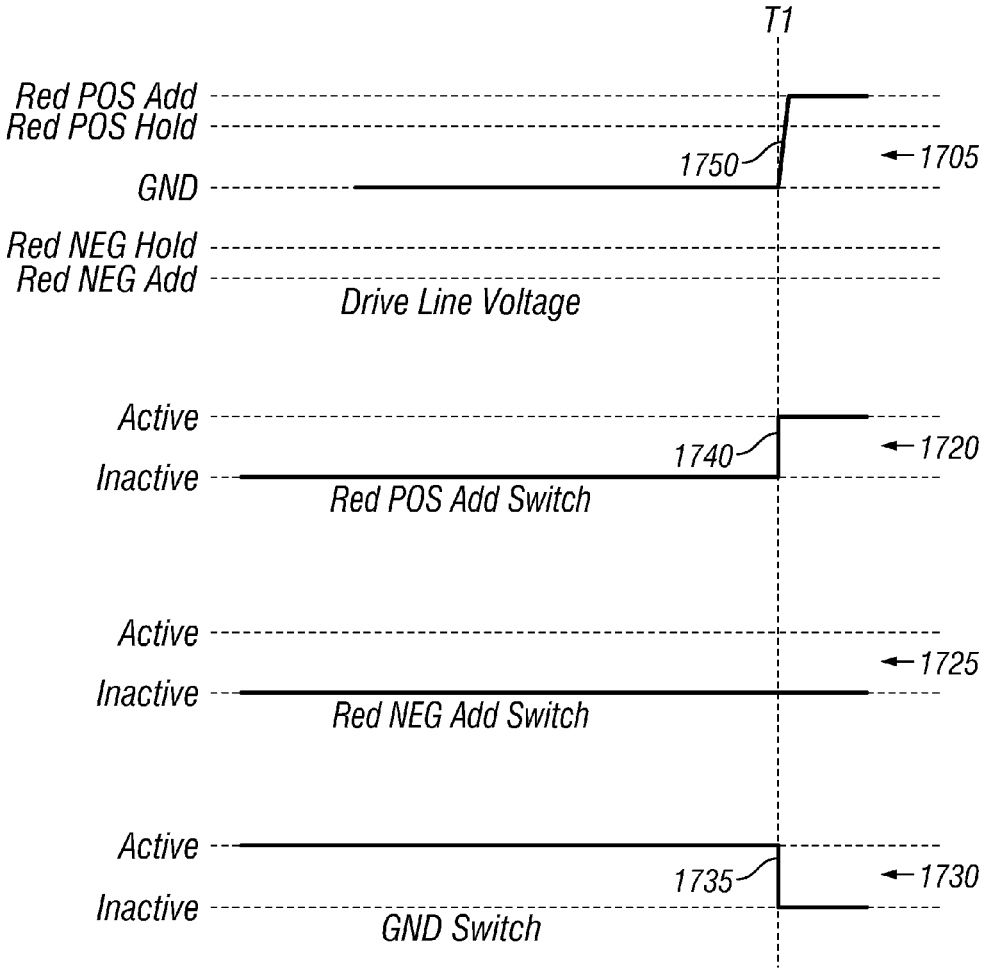
FIG. 17 is another exemplary timing diagram illustrating the operation of a portion of a switch array of FIG. 8.

FIG. 17 is another exemplary timing diagram illustrating the operation of a portion of a switch array of FIG. 8 and FIG. 15. Waveform 1705 represents the voltage level over time on a drive line, such as drive line 1533 of FIG. 15 or drive line 962 of FIG. 9. As depicted, the drive line voltage may change between multiple distinct levels. In one embodiment, the drive line voltage may change between a positive address voltage level, a ground voltage level, and a negative address voltage level. As discussed above with respect to FIGS. 5*a* and 5*b*, these voltage levels may be used in conjunction with positive and negative hold voltages to drive an IMOD display. Further, as described above, in some embodiments, each drive line may be used to drive common lines of each color. Thus, each drive line may be configured to change between a positive address voltage and negative address voltage for each color. In addition, the drive lines may be configured to change to a ground voltage. In an embodiment using three colors, red, green, and blue, this configuration results in a possible seven voltage levels for each drive line. Other voltage levels may also be used. In other embodiments, the number and configuration of drive lines may be selected such that each drive line is only used for driving common lines of the same color. For example, the number of drive lines may be a multiple of the number of colors. In this embodiment, each drive line might only be configured to vary between a subset of the possible voltage levels instead of being capable of producing every voltage level for any color. For the purposes of explanation, the waveform 1705 represents the voltage of a drive line during a time when it is being used to drive a common line associated with the color red.

FIG. 17 also illustrates a red positive address switch waveform 1720. Red positive address switch waveform 1720 may represent the behavior of a switch, such as switch 1550 of FIG. 15, over time. The active and inactive states of waveform 1720 refer to whether or not a switch, such as switch 1550 of FIG. 15, is coupling the drive line to a particular voltage supply line such as the red positive address supply line 11505 of FIG. 15. FIG. 17 further depicts a red negative address switch waveform 1725. Red negative address switch waveform 1725 may represent the behavior of a switch, such as switch 1555 of FIG. 15, over time. As with waveform 11720, the active and inactive states of waveform 1725 refer to whether or not a switch, such as switch 1555 of FIG. 15, is coupling the drive line to a particular voltage supply line. In the case of red negative address switch waveform 1525, the supply voltage line in question is a red negative address supply line, such as supply line 1509 of FIG. 15. FIG. 17 also illustrates a ground switch waveform 1730. Ground switch waveform 1730 may represent the behavior of a switch, such as switch 1570 of FIG. 15, over time. As with waveform 1720, the active and inactive states of waveform 1730 may refer to whether or not a switch, such as switch 1570 of FIG. 15, is coupling the drive to a particular voltage supply line. With respect to waveform 1730, the voltage supply line may be a ground voltage supply line such as ground voltage supply line 1521 of FIG. 15.

FIG. 17 illustrates an exemplary relationship between the activity levels of drive line switches, such as switches 1550, 1055, and 1070 of FIG. 15, and the voltage level on a drive line, such as the drive line 1533 of FIG. 15 or 962 of FIG. 9. At time T1, the ground switch changes to an inactive state as shown by waveform segment 11735 and the red positive address switch changes to an active state as shown by waveform segment 1740. In reference to the elements of FIG. 15, this means that switch 1570 goes inactive, decoupling drive line 1533 from the ground voltage supply line 1521. Further, switch 1550 goes active coupling the drive line 1533 to the red positive address voltage supply line 1505. As a result, the voltage on the drive line changes from ground to red positive address as illustrated in wave form segment 1750.

Contrasted with FIG. 12 the timing diagram of FIG. 17 does not require the manipulation of switches associated with hold voltage levels. As described above, the hold voltages are instead supplied via the hold voltage supply lines already connected to the common lines. Thus the drive line voltage waveform is greatly simplified as is the corresponding logic for controlling the drive line wave form. In addition, the number of switches used to generate the driving voltage waveform is reduced.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the invention may be embodied within a form that does not provide all of the features and benefits set forth herein, as some features may be used or practiced separately from others.

What is claimed is:

1. An apparatus for driving a display, the apparatus comprising:

a plurality of rows and columns of display elements, wherein each display element is configured to be placed in a plurality of discrete states;

a first hold voltage supply line configured to supply a first hold voltage;

a second hold voltage supply line configured to supply a second hold voltage;

one or more drive lines configured to supply a driving voltage waveform;

a waveform generator configured to generate the driving voltage waveform on the one or more drive lines, wherein the driving voltage waveform is configured to set each of the display elements in one of the discrete states;

a first switch configured to selectively couple a first one of the plurality of rows or columns to the first hold voltage supply line, wherein the first hold voltage is configured to maintain the discrete state of each of the display elements resulting from the driving voltage waveform;

a second switch configured to selectively couple the first one of the rows or columns to the second hold voltage supply line, wherein the second hold voltage is configured to maintain the discrete state of each of the display elements resulting from the driving voltage waveform; and a third switch configured to selectively couple the first one of the rows or columns to a first drive line of the one or more drive lines.

2. The apparatus of claim 1, wherein the waveform generator comprises a processor configured to drive the first, second, and third switches.

3. The apparatus of claim 2, wherein the waveform generator comprises:

a plurality of voltage supply lines, wherein each of the plurality of voltage supply lines is configured to supply a particular voltage; and a plurality of switches, wherein each of the plurality of switches is configured to selectively couple one of the plurality of voltage supply lines to one of the one or more drive lines, wherein the processor is configured to drive the plurality of switches to generate the driving voltage waveform.

4. The apparatus of claim 3, wherein the plurality of voltage supply lines comprises:

a positive address voltage supply line; and a negative address voltage supply line.

5. The apparatus of claim 4, wherein the plurality of voltage supply lines further comprises a ground voltage supply line.

6. The apparatus of claim 4, wherein the positive address and negative address voltage supply lines are each associated with one of a set of colors.

7. The apparatus of claim 6, wherein the set of colors comprises red, green and blue.

8. The apparatus of claim 1, further comprising:

a third hold voltage supply line configured to supply a third hold voltage;

a fourth hold voltage supply line configured to supply a fourth hold voltage;

a fourth switch configured to selectively couple a second one of the rows or columns to the third hold voltage supply line;

a fifth switch configured to selectively couple the second one of the rows or columns to the fourth hold voltage supply line; and a sixth switch configured to selectively couple the second one of the rows or columns to the first drive line.

9. The apparatus of claim 8:

wherein the first and second hold voltages are positive and negative hold voltages corresponding to a first color; and wherein the third and fourth hold voltages are positive and negative hold voltages corresponding to a second color.

10. The apparatus of claim 1, further comprising a plurality of bi-stable display elements arranged in the plurality of rows or columns.

11. A method of displaying information on a display, the display comprising a plurality of rows and columns of display elements, wherein each display element is configured to be set in a plurality of discrete states with a driving voltage waveform, the method comprising:

activating a first switch to couple a first one of a plurality of rows or columns to a first hold voltage supply line configured to supply a first hold voltage, wherein the first hold voltage is configured to maintain the discrete state of each of the display elements resulting from the driving voltage waveform;

deactivating the first switch to uncouple the first one of the rows or columns from the first hold voltage supply line;

generating the driving voltage waveform on a first drive line;

activating a second switch to couple the first one of the rows or columns to the first drive line;

deactivating the second switch to uncouple the first one of the rows or columns from the first drive line; and activating a third switch to couple the first one of the rows or columns to a second hold voltage supply line configured to supply a second hold voltage, wherein the second hold voltage is configured to maintain the discrete state of each of the display elements resulting from the driving voltage waveform.

12. The method of claim 11, wherein generating the driving voltage waveform comprises selectively coupling the first drive line to one or more voltage supply lines of a plurality of voltage supply lines.

13. The method of claim 12, wherein coupling the first drive line to one or more voltage supply lines comprises activating a corresponding one or more switches of a plurality of switches.

14. The method of claim 12, wherein the plurality of voltage supply lines further comprises a ground voltage supply line.

15. The method of claim 12, wherein the plurality of voltage supply lines comprises:

a positive address voltage supply line; and a negative address voltage supply line.

16. The method of claim 15, wherein the positive address and negative address voltage supply lines are each associated with one of a set of colors.

17. The method of claim 16, wherein the set of colors comprises red, green and blue.

18. The method of claim 11, further comprising:

activating a fourth switch to couple a second one of the rows or columns to a third hold voltage supply line configured to supply a third hold voltage;

deactivating the fourth switch to uncouple the second one of the rows or columns from the third hold voltage supply line;

activating a fifth switch to couple the second one of the rows or columns to the first drive line;

deactivating the fifth switch to uncouple the second one of the rows or columns from the first drive line; and activating a sixth switch to couple the second one of the rows or columns to a fourth hold voltage supply line configured to supply a fourth hold voltage.

19. The method of claim 18:

wherein the first and second hold voltages are positive and negative hold voltages corresponding to a first color; and wherein the third and fourth hold voltages are positive and negative hold voltages corresponding to a second color.

20. The method of claim 11, wherein the display comprises a plurality of bi-stable display elements arranged in the plurality of rows or columns.

21. The method of claim 11, further comprising:

obtaining information to be displayed; and writing a portion of the information to be displayed to the first one of the rows or columns while the second switch is active.

22. An apparatus for driving a display, the apparatus comprising:

a plurality of rows and columns of means for displaying an image, wherein each displaying means is configured to be set in a plurality of discrete states;

means for supplying a first hold voltage;

means for supplying a second hold voltage;

one or more means for supplying a driving voltage waveform, wherein the driving voltage waveform is configured to set each of the displaying means in one of the discrete states;

means for generating the driving voltage waveform on the one or more means for supplying the driving voltage waveform;

means for selectively coupling a first one of a plurality of rows or columns to the means for supplying the first hold voltage, wherein the first hold voltage is configured to maintain the discrete state of each of the displaying means resulting from the driving voltage waveform;

means for selectively coupling the first one of the rows or columns to the means for supplying the second hold voltage, wherein the second hold voltage is configured to maintain the discrete state of each of the displaying means resulting from the driving voltage waveform; and means for selectively coupling the first one of the rows or columns to a first one of the one or more means for supplying a driving voltage waveform.

23. The apparatus of claim 22, further comprising:

means for supplying a third hold voltage;

means for supplying a fourth hold voltage;

means for selectively coupling a second one of the rows or columns to the means for supplying the third hold voltage;

means for selectively coupling the second one of the rows or columns to the means for supplying the fourth hold voltage; and means for selectively coupling the second one of the rows or columns to the means for generating the driving voltage waveform.

24. A non-transitory computer-readable medium having stored thereon, instructions that, if executed by a computing device, cause the computing device to perform a method of displaying information on a display, the display comprising a plurality of rows and columns of display elements, wherein each display element is configured to be set in a plurality of discrete states with a driving voltage waveform, the method comprising:

activating a first switch to couple a first one of a plurality of rows or columns to a first hold voltage supply line configured to supply a first hold voltage, wherein the first hold voltage is configured to maintain the discrete state of each of the display elements resulting from the driving voltage waveform;

deactivating the first switch to uncouple the first one of the rows or columns from the first hold voltage supply line;

generating the driving voltage waveform on a first drive line;

activating a second switch to couple the first one of the rows or columns to the first drive line;

deactivating the second switch to uncouple the first one of the rows or columns from the first drive line; and activating a third switch to couple the first one of the rows or columns to a second hold voltage supply line configured to supply a second hold voltage, wherein the second hold voltage is configured to maintain the discrete state of each of the display elements resulting from the driving voltage waveform.

25. The non-transitory computer-readable medium of claim 24, wherein the method further comprises:

activating a fourth switch to couple a second one of the rows or columns to a third hold voltage supply line configured to supply a third hold voltage;

deactivating the fourth switch to uncouple the second one of the rows or columns from the third hold voltage supply line;

activating a fifth switch to couple the second one of the rows or columns to the first drive line;

deactivating the fifth switch to uncouple the second one of the rows or columns from the first drive line; and activating a sixth switch to couple the second one of the rows or columns to a fourth hold voltage supply line configured to supply a fourth hold voltage.

* * * * *